US012685367B2

(12) United States Patent
Bonfiglioli et al.

(10) Patent No.: US 12,685,367 B2
(45) Date of Patent: Jul. 21, 2026

(54) FOOTWEAR SOLE STRUCTURE

(71) Applicant: NIKE, Inc., Beaverton, OR (US)

(72) Inventors: Marcos Bonfiglioli, Portland, OR (US); John Cross, Portland, OR (US); Ryan R. Larson, Portland, OR (US); Shamees Mohamed, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/627,261

(22) Filed: Apr. 4, 2024

(65) Prior Publication Data

US 2024/0335002 A1 Oct. 10, 2024

Related U.S. Application Data

(60) Provisional application No. 63/458,000, filed on Apr. 7, 2023.

(51) Int. Cl.
*A43B 13/18* (2006.01)
*A43B 13/14* (2006.01)

(52) U.S. Cl.
CPC ..... *A43B 13/181* (2013.01); *A43B 13/146* (2013.01)

(58) Field of Classification Search
CPC ..... A43B 13/181; A43B 13/18; A43B 13/14; A43B 13/185
USPC ..... 36/28
See application file for complete search history.

(56) References Cited

U.S. PATENT DOCUMENTS

| | | | | |
|---|---|---|---|---|
| 5,311,674 | A * | 5/1994 | Santiyanont | A43B 13/181 36/35 R |
| 5,337,492 | A * | 8/1994 | Anderie | A43B 13/181 36/114 |
| 5,853,844 | A * | 12/1998 | Wen | A43B 13/181 52/177 |
| 6,763,611 | B1 * | 7/2004 | Fusco | A43B 13/181 36/27 |
| 6,898,870 | B1 * | 5/2005 | Rohde | A43B 13/184 36/3 R |
| 2004/0221483 | A1 * | 11/2004 | Cartier | A43B 13/181 36/27 |
| 2006/0065499 | A1 * | 3/2006 | Smaldone | A43B 13/183 267/141 |
| 2007/0039204 | A1 | 2/2007 | Wyszynski et al. | |
| 2007/0256326 | A1 * | 11/2007 | Jarvis | A43B 13/226 36/35 R |
| 2007/0277395 | A1 * | 12/2007 | Aveni | F16F 1/371 36/35 B |

(Continued)

OTHER PUBLICATIONS

International Search Report and Written Opinion received for PCT Patent Application No. PCT/US2024/023352, mailed on Sep. 3, 2024, 20 pages.

(Continued)

*Primary Examiner* — Marie D Bays
(74) *Attorney, Agent, or Firm* — Shook, Hardy & Bacon L.L.P.

(57) ABSTRACT

A sole structure for a footwear article includes a system of support structures that are arranged in a subunit. In some examples, the subunit can be at least partially enclosed by an exoskeleton. In some instances, the system of support structures can comprise at least a portion of a cartridge that can connect to another component in the sole structure. The cartridge can, in some examples, operate to attenuate a force.

20 Claims, 23 Drawing Sheets

(56) References Cited

U.S. PATENT DOCUMENTS

2012/0042540 A1* 2/2012 Miner ..... A43B 13/04 12/146 B
2013/0273347 A1* 10/2013 Jacobsen ..... B32B 5/028 428/304.4
2015/0033581 A1* 2/2015 Barnes ..... A43B 13/188 36/83
2015/0113828 A1* 4/2015 Yang ..... A43B 7/1435 267/142
2015/0272272 A1* 10/2015 Scofield ..... A43B 1/0009 36/28
2016/0242502 A1* 8/2016 Spanks ..... A43B 13/181
2016/0374428 A1* 12/2016 Kormann ..... A43B 7/141 36/28
2017/0231322 A1* 8/2017 Gheorghian ..... A43B 13/182 267/141
2017/0325544 A1* 11/2017 Ngene ..... A43B 13/148
2018/0271211 A1* 9/2018 Perrault ..... B33Y 50/00
2018/0271213 A1* 9/2018 Perrault ..... A43B 13/141
2018/0317600 A1* 11/2018 Campos ..... A43B 13/187
2020/0093221 A1* 3/2020 Caldwell ..... A43B 1/0009
2020/0268098 A1* 8/2020 Jeng ..... A43B 13/181
2021/0186152 A1* 6/2021 Kumar ..... A43B 13/125
2021/0195995 A1* 7/2021 Sakamoto ..... A43B 7/32
2022/0110406 A1* 4/2022 Salari-Sharif ..... A43B 13/125
2022/0110407 A1* 4/2022 Hettinga ..... A43B 3/44
2022/0202135 A1* 6/2022 Sakamoto ..... A43B 21/32
2022/0408878 A1* 12/2022 Iwasa ..... A43B 13/125
2022/0408880 A1* 12/2022 Iwasa ..... A43B 13/181
2023/0138934 A1* 5/2023 Kita ..... A43B 13/181 36/28
2023/0143450 A1* 5/2023 Ponomarev ..... A43B 7/24 36/25 R
2023/0264450 A1* 8/2023 Bhat ..... B33Y 80/00 428/34.1
2024/0188678 A1* 6/2024 Mckenzie ..... A43B 13/187
2024/0225182 A1* 7/2024 Baghdadi ..... A43B 13/181
2024/0365923 A1* 11/2024 Salari-Sharif ..... A43B 13/186
2025/0000205 A1* 1/2025 Mccutcheon ..... A43B 17/00

OTHER PUBLICATIONS

Invitation to Pay Additional Fees for PCT Patent Application No. PCT/US2024/023352, mailed on Jul. 11, 2024, 11 pages.

* cited by examiner

FOOTWEAR SOLE STRUCTURE

CROSS REFERENCE TO RELATED APPLICATIONS

This application claims the priority benefit of U.S. Application No. 63/458,000 (filed Apr. 7, 2023), which is hereby incorporated by reference in its entirety.

TECHNICAL FIELD

This disclosure relates to a sole structure for a footwear article.

BACKGROUND

Footwear articles often include one or more sole structures that provide various functions. For instance, a sole structure generally protects a wearer's foot from environmental elements and from a ground surface. In addition, a sole structure may attenuate an impact or a force caused by a ground surface or other footwear-contacting surfaces.

BRIEF DESCRIPTION OF THE DRAWINGS

This subject matter is described in detail herein with reference to drawing figures, which are incorporated herein by reference in their entirety.

DETAILED DESCRIPTION

Figure 1:
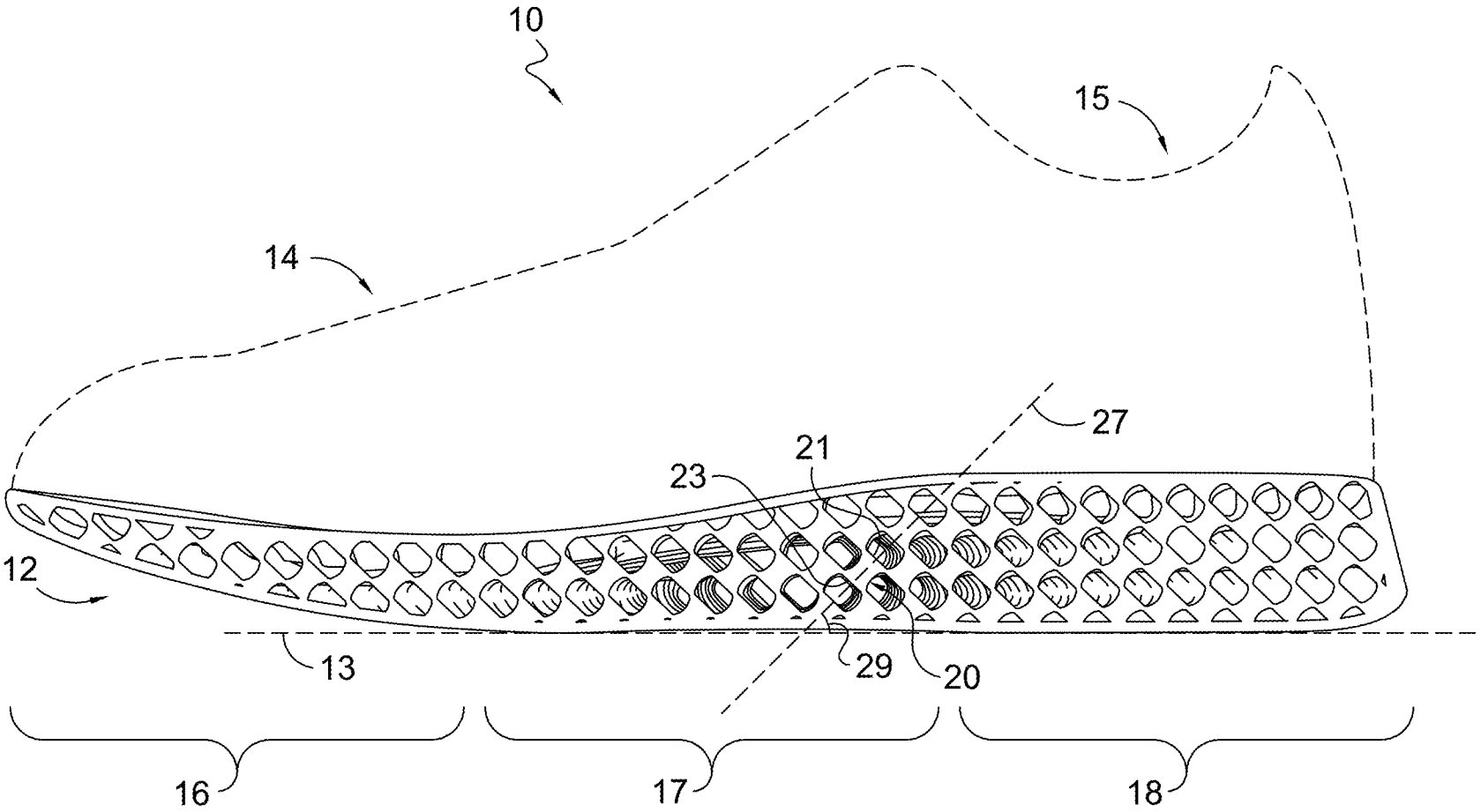
FIG. 1 depicts a side view of a footwear article in accordance with an aspect of this disclosure.

The subject matter described in this Specification generally relates to, among other things, a support structure for a footwear sole, a support system having the support structures for a footwear sole, a footwear sole including the support system, a footwear article, a method of making any of the foregoing, and any combination thereof. An exemplary footwear article 10 having a system of support structures is depicted in FIG. 1. The footwear article includes a sole 12, and the sole 12 includes a plurality of support structures arranged across various regions of the sole 12. One of the support structures is identified with reference numeral 20, and the other support structures might include a same or similar construction.

Figure 14:
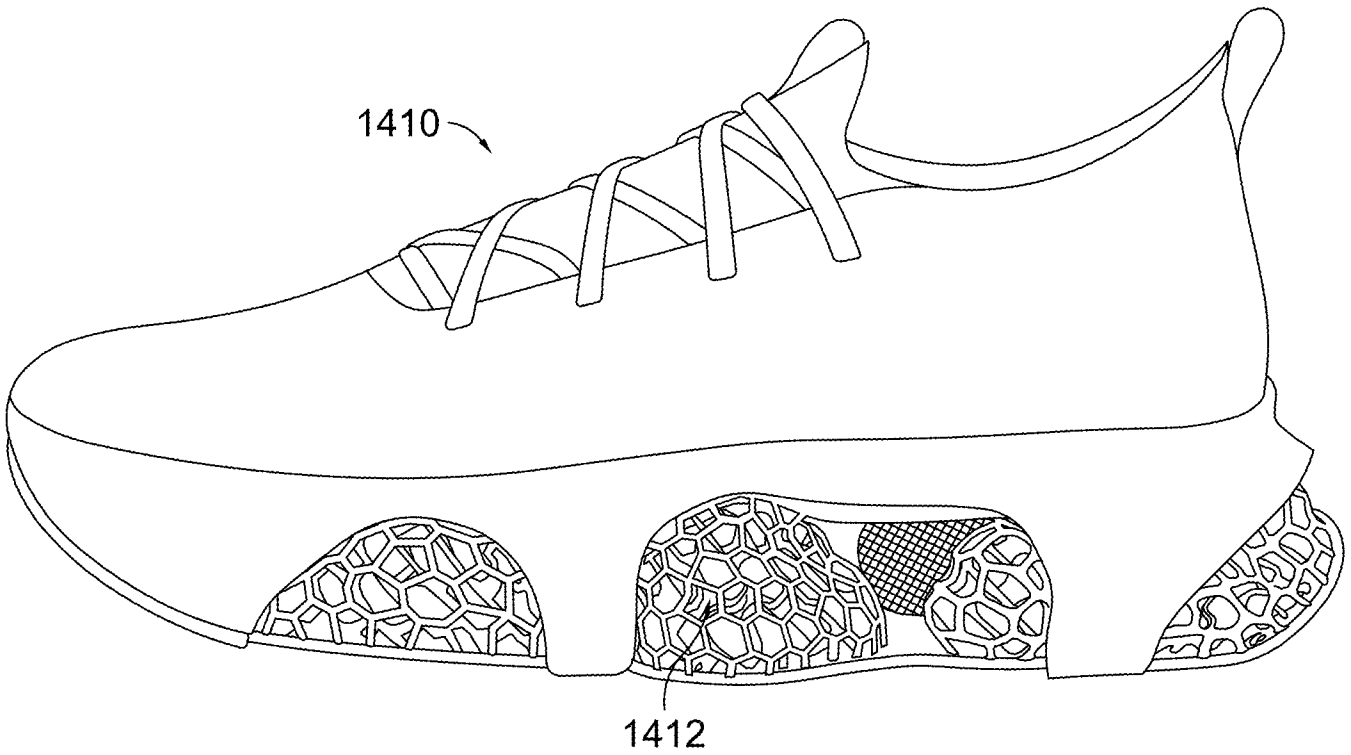
FIG. 14 depicts a footwear article that includes support structures associated with an exoskeleton, in accordance with examples of this disclosure.

In another example, the present disclosure can include one or more of the support structures (e.g., a tubular support structure, such as the support structure 20, or a three-dimensional (3D) lattice) at least partially enclosed within an exoskeleton. For example, referring to FIG. 12, an example of a footwear article 1210 is depicted, which includes an exoskeleton 1218 having a lattice-like envelope of frame members (e.g., support struts, beams, ties, etc.) that form a network of interconnected nodes. In some examples, frame members can include properties (e.g., length, cross-sectional dimensionality, degree of rectilinearity or curvilinearity, etc.) that vary among the exoskeleton 1218, and in this sense, the exoskeleton 1218 can be described as irregular, varied, free-form, or asymmetric. Referring to FIG. 14, in some examples, a footwear article 1410 can include an exoskeleton 1412 with frame members that are organized in a more consistent pattern and/or with more consistent properties (e.g., length, cross section, etc.), such as with a repeating pattern of n-polygonal shapes (e.g., triangle, rectangle, diamond, pentagon, hexagon, etc.). In examples, the exoskeleton 1412 can also vary in different respects (e.g., dimensionality of frame members, size of n-polygonal shapes, etc.), and the exoskeleton 1412 can vary to a lesser extent than the exoskeleton 1218.

Figure 12:
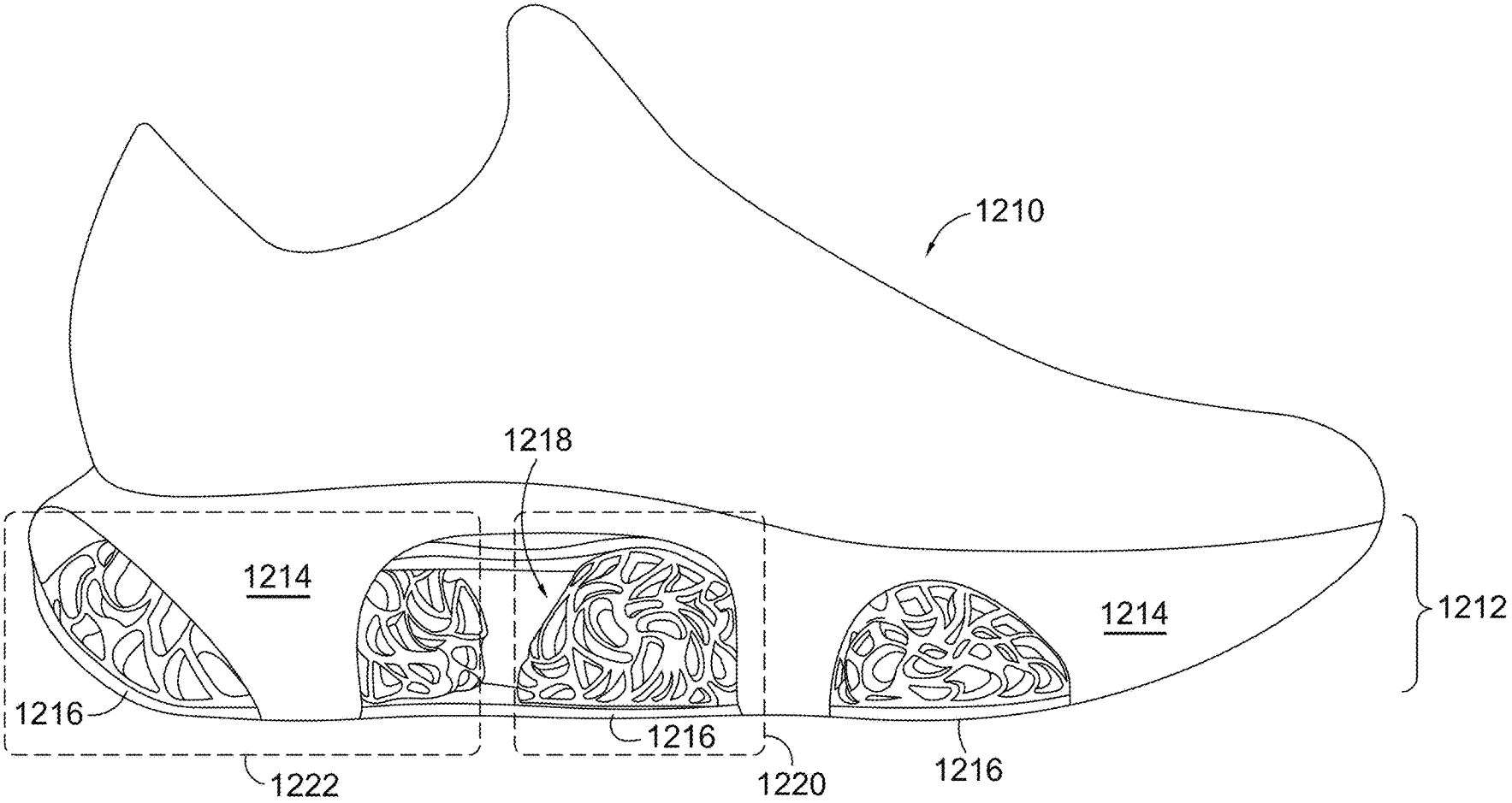
FIG. 12 depicts an example of a footwear article that includes support structures associated with an exoskeleton, in accordance with examples of this disclosure.

In at least some examples, the present disclosure can include one or more discrete groupings of support structures arranged in one or more locations within the sole structure. For example, FIGS. 12 and 14 depict examples, in which discrete groupings of support structures are located in different portions of the sole and each discrete grouping is at least partially enclosed within an exoskeleton.

In some examples, discrete groupings of support structures can be arranged in one or more locations of the sole without any exoskeleton surrounding the grouping. For example, referring to FIGS. 15A-15E, various different views are provided of a sole component that includes discrete groupings of support structures without an exoskeleton enclosing the groupings.

In examples, the system of support structures (e.g., with or without an envelope or exoskeleton) might be organized into various types of arrangements, such as a matrix or an array including multiple stacked, offset rows of support structures. As described in other parts of this disclosure, the support structures (e.g., support structure 20) operate at an individual structure level, as well as collectively as a system, to provide various functionality for a footwear article. Some of that functionality provided by the sole 12 is generally described in this portion of the disclosure, and subsequent portions of the disclosure provide additional details explaining some of the various aspects and how they operate to provide the functionality. For example, in accordance with aspects of this disclosure, a footwear sole structure may in some instances provide a cushioning functionality, in which the sole absorbs at least a portion of a force, such as by compressing, buckling, collapsing, or any combination thereof, when a wearer's foot strikes a ground surface (e.g., when walking, running, jumping, and the like). In some other instances, the footwear sole structure may also provide an energy-return functionality, in which the sole stores elastic potential energy when absorbing the force and releases kinetic energy upon removal of the force.

As described in more detail in other parts of this disclosure, in accordance with aspects of this disclosure, various factors might contribute to the cushioning functionality and energy-return functionality, such as the configuration of a support structure, the arrangement of a system of support structures, the material(s) from which support structures are constructed, or any combination thereof. In contrast to some traditional sole technology, such as foam soles or alternative cell-based systems, aspects of this disclosure describe a system of support structures that provide cushioning and energy return and that might be lighter weight. In some instances, the lighter weight property (e.g., relative to some traditional foam soles or alternative cell-based systems) results from using less material, since the configuration of each support structure, and the support structures collectively, contributes cushioning and energy return, such that the functioning of the sole is not reliant on only the material properties of the base foam material. Stated differently, some traditional foam soles rely primarily on the material properties of the underlying foam to provide cushioning and energy return, and in contrast, aspects of this disclosure leverage the functional properties of the support structures and support-structure system (in addition to material properties), which allows the use of less material. Furthermore, as compared with alternative cell-based structures that might also utilize 3D-printed structures, the support structures and support-structure systems of this disclosure provide improved cushioning and energy return, which again allows for a materials reduction by reducing cell wall thickness, numbers of cells, and the like while maintaining functionality.

In at least some examples of the present disclosure, an exoskeleton can at least partially enclose, contain, constrain, protect, etc. the support structures and the support-structure system(s). For example, the exoskeleton can reduce the likelihood that debris might get captured among the support structures. In addition, the exoskeleton can permit the support structures to operate by compressing or collapsing, while still constraining lateral expansion, which can increase stiffness associated with the support system. In at least some examples, the exoskeleton can operate to enhance responsiveness, such as by providing, or contributing to, a restoring force, which can help the system return to a pre-compressed state, such as after a force has been removed.

In at least some examples, groupings of support structures (e.g., with or without an exoskeleton) can provide zonal properties (e.g., cushion and responsiveness) that are tailored to a respective region based on the properties of the support structures within that grouping.

In FIG. 1, the footwear article 10 includes a sole 12 and an upper 14. The upper 14 and the sole 12 generally form a foot-receiving space that encloses at least part of a foot when the footwear is worn or donned. That is, typically a portion of the upper overlaps with, and is connected to, a portion of the sole 12. This overlapping region, and the resulting coupling mechanism (e.g., stitching, bonding, adhering, integrally forming, co-molding, etc.), is sometimes referred to as a "biteline." The foot-receiving space is accessible by inserting a foot through an opening formed by the ankle collar 15. When describing various aspects of the footwear 10, relative terms may be used to aid in understanding relative positions. For instance, the footwear 10 may be divided into three general regions: a forefoot region 16, a mid-foot region 17, and a heel region 18. The footwear 10 also includes a lateral side, a medial side, a superior portion, and an inferior portion.

The forefoot region 16 generally includes portions of the footwear 10 corresponding with the toes and the joints connecting the metatarsals with the phalanges. The mid-foot region 17 generally includes portions of footwear 10 corresponding with the arch area of the foot, and the heel region 18 corresponds with rear portions of the foot, including the calcaneus bone. In addition, portions of a footwear article may be described in relative terms using these general zones. For example, a first structure may be described as being more heelward than a second structure, in which case the second structure would be more toeward and closer to the forefoot. Further, a coronal or transverse plane of the shoe, spaced an equidistance between the forward-most point of the forefoot region and the rearward-most point of the heel region, may be used to describe relational qualities of some parts of a shoe.

The lateral side and the medial side extend through each of regions 16, 17, and 18 and correspond with opposite sides of footwear 10. More particularly, the lateral side corresponds with an outside area of the foot (i.e., the surface that faces away from the other foot), and the medial side corresponds with an inside area of the foot (i.e., the surface that faces toward the other foot). In addition, these terms may also be used to describe relative positions of different structures. For example, a first structure that is closer to the inside portion of the footwear article might be described as medial to a second structure, which is closer to the outside area and is more lateral. In other aspects, a sagittal or parasagittal plane of the shoe, may be used to describe relational qualities of some parts of a shoe. Furthermore, the superior portion and the inferior portion also extend through each of the regions 16, 17, and 18, and the terms superior and inferior may also be used in relation to one another. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface. A transverse plane of the shoe may be used in some aspects to describe relational qualities of some parts of a shoe. These regions 16, 17, and 18, sides, and portions are not intended to demarcate precise areas of footwear 10. They are intended to represent general areas of footwear 10 to aid in understanding the various relative descriptions provided in this Specification. In addition, the regions, sides, and portions are provided for explanatory and illustrative purposes and are not meant to require a human being for interpretive purposes. Although FIG. 1 depicts one certain style of footwear, such as footwear worn when engaging in athletic activities (e.g., cross-training shoes, running shoes, walking shoes, and the like), the subject matter described herein may be used in combination with other styles of footwear, such as dress shoes, sandals, loafers, boots, and the like.

The sole 12 might comprise various components. For example, the sole 12 may comprise an outsole with tread or traction elements made of a relatively hard and durable material, such as rubber or durable foam that contacts the ground, floor, or other surface. The sole 12 may further comprise a midsole formed from a material that provides cushioning and absorbs force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (such as springs, air bags, and the like), functional components (such as motion control elements to address pronation or supination), protective elements (such as resilient plates to prevent damage to the foot from hazards on the floor or ground), and the like. As previously indicated, an aspect of the present disclosure includes a midsole having a system of support structures (e.g., support structure 20).

Figure 2:
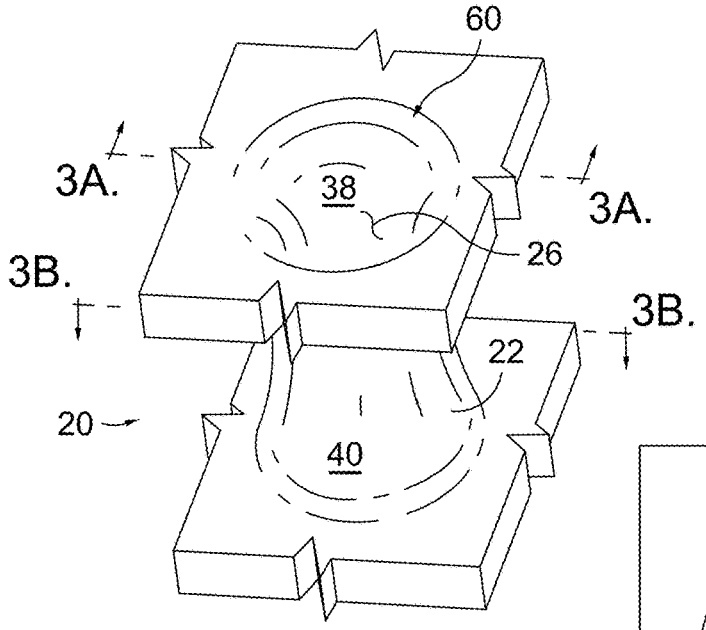
FIG. 2 depicts a support structure in accordance with an aspect of this disclosure.
Figure 3B:
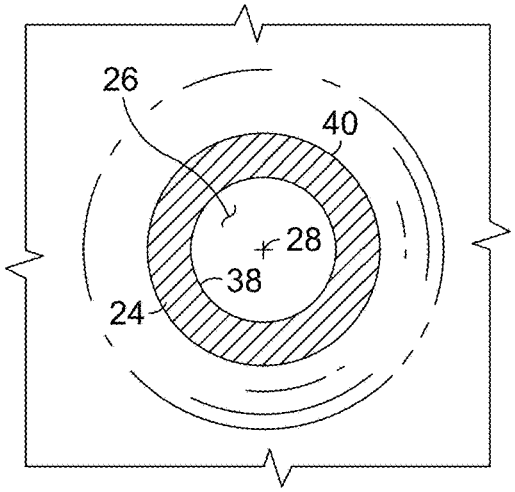
FIGS. 3A and 3B each depicts a respective cross-sectional view of the support structure in FIG. 2 in accordance with an aspect of this disclosure.
Figure 3A:
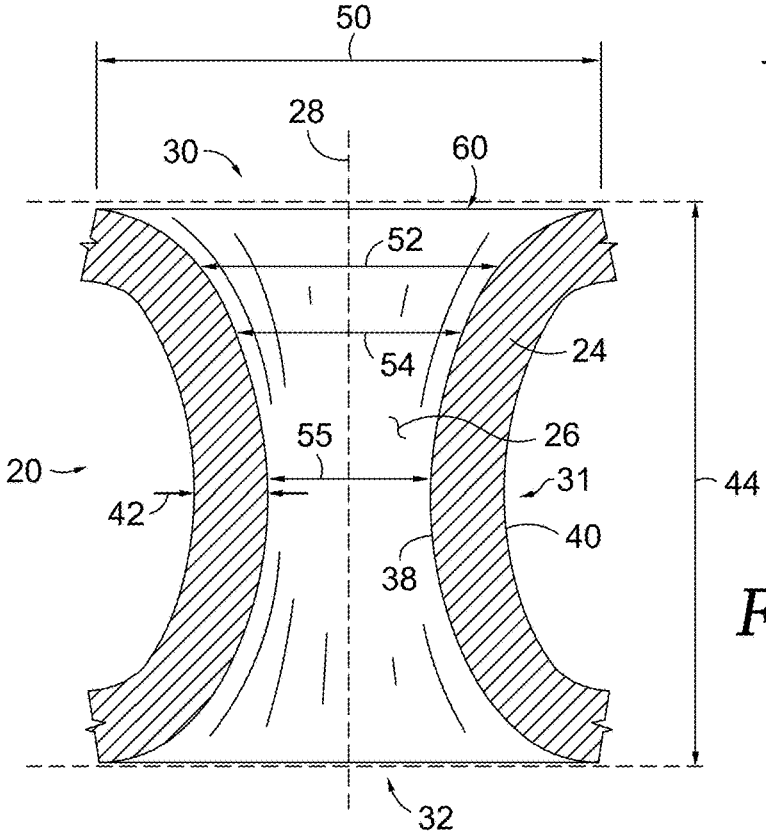

Referring to FIG. 2, the support structure 20 is illustrated in accordance with one aspect of this disclosure, and FIGS. 3A and 3B depict cross-sectional views of the support structure 20 taken at the reference 3A-3A and 3B-3B identified in FIG. 2. In FIG. 2, the support structure 20 is depicted as a discrete element, separate from the sole 12 in FIG. 1, and one aspect of the present disclosure is directed to the discrete support structure 20, either independently from, or included in, a sole. The support structure 20 includes a tubular body 22 including a wall 24 that partially encloses a hollow cavity 26 and that extends circumferentially around a reference axis 28. As used in this disclosure, a reference axis is a reference line that passes through the hollow cavity 26 at a series of points equidistant between opposing sides of the interior surface 38. The wall 24 includes an exterior surface 40 facing away from the hollow cavity 26, an interior surface 38 facing towards the hollow cavity 26, and a wall thickness 42 between the exterior surface 40 and the interior surface 38.

The tubular body 22 includes a first end 30 and a second end 32 that are spaced apart in the axial direction, and the support structure 20 includes a height 44 measured from the first end 30 to the second end 32. The tubular body 22 is open at the first end 30 and the second end 32, such that the wall 24 does not enclose these portions of the tubular body 22. In addition, the tubular body 22 includes one or more diameters (e.g., 50, 52, 54, and 55) that might vary from one portion of the tubular body to another.

Size, shape, dimensions, and other elements of the support structure might be described, defined, or prescribed in various manners. In addition, as is described in other portions of this disclosure, the wall thickness 42, the height 44, and other characteristics might vary depending on various factors. For explanatory purposes, some aspects of these features will be described in this portion of the disclosure with reference to FIGS. 2, 3A, and 3B, and these aspects may be revisited and expanded upon in other parts of the disclosure.

In one aspect of the disclosure, the tubular-wall thickness 42 is in a range of about 0.50 mm to about 1.5 mm. In a further aspect, the tubular-wall thickness 42 is in a range of about 0.75 mm to about 1.25 mm. In a further aspect, the tubular-wall thickness 42 is in a range of about 0.90 mm to about 1.15 mm. In still a further aspect, the tubular-wall thickness 42 is about 1.05 mm. In yet another aspect, the tubular-wall thickness 42 is about 1.15 mm. These are examples of some aspects of the tubular-wall thickness 42, which may vary based on various factors and considerations as will be described in other parts of this disclosure. In other aspects, the tubular-wall thickness 42 may be less than these described ranges, or may be greater than these described ranges.

The support structure 20 also includes the height 44 measured from the first end 30 to the second end 32. In one aspect of the disclosure, the height 44 is in a range of about 0.75 cm to about 1.5 cm. In a further aspect, the height 44 is in a range of about 1 cm to about 1.25 cm. In still a further aspect, the height 44 is about 1.05 cm. In yet another aspect, the height 44 is about 1.15 cm. These are examples of some aspects of the height 44, which may vary based on various factors and considerations as will be described in other parts of this disclosure. In other aspects, the height 44 may be less than these described ranges, or may be greater than these described ranges.

As depicted in FIGS. 2, 3A, and 3B, in some aspects of this disclosure, the wall 24 curves inward as the wall 24 continuously extends between the first end 30 and the second end 32. The curve of the wall, as well as the resulting overall structure of the wall surfaces, might be described in various manners. Furthermore, the curvature of the wall 24 may vary in different aspects. For example, the tubular wall 24 includes the interior surface 38 facing towards the cavity 26, and in one aspect, the interior surface 38 is convex as it extends from the first end 30 to the second end 32, as depicted in FIG. 3A. Furthermore, the interior surface 38 maintains a convex nature from the first end 30 to the second end 32 as the interior surface 38 extends around the reference axis 28. In addition, as depicted in FIG. 3B, the interior surface 38 is concave in a cross-sectional plane extending perpendicular to the axis as the wall 24 extends around the axis 28. The tubular wall 24 also includes the exterior surface 40 facing away from the cavity 26, and in another aspect, the exterior surface 40 is concave as the exterior surface 40 extends from the first end 30 to the second end 32. Similar to the interior surface 38, the exterior surface 40 maintains a concave nature from the first end 30 to the second end 32 as the exterior surface 40 extends around the reference axis 28. Moreover, depicted in FIG. 3B, the exterior surface 40 is convex in a cross-sectional plane extending perpendicular to the axis 28 as the wall 24 extends around the axis 28.

Because of the tubular nature of the support structure 20, the wall 24 includes an interior diameter, and the interior diameter gradually changes from the first end 30 to the second end 32. That is, at each end of the support structure 20, the interior diameter includes a respective value, and the interior diameter gradually decreases as the wall 24 extends away from the ends and curves towards a middle region 31 of the tubular body 22. For example, FIG. 3A depicts a first diameter 50 of the interior surface 38 at the first end 30, a second diameter 52 that is smaller than the first diameter 50, and a third diameter 54 that is smaller than the second diameter 52. In one aspect, each end of the tubular body 22 includes a rim 60, which includes a circumferential portion of the interior surface having a largest diameter before the interior surface either flattens out into a plane or transitions to another structure (as is describe in subsequent portions). In aspects of this disclosure, the diameters of the tubular body 22 may vary. For example, in one aspect, the largest diameter 50 at the rim of each end (i.e., interior diameter) is in a range of approximately 4 mm to approximately 8 mm, and a narrowest interior diameter 55 of the tubular body (e.g., between the ends 30 and 32) is in a range of approximately 2 mm to approximately 5 mm. In light of the range of heights 44 identified above, in one aspect of the disclosure, the support structure 20 includes a height 44 to rim diameter 50 in a range of approximately 1:1 to approximately 4:1.

In one aspect of the disclosure, the curvature of the exterior surface 40 extending from the first end 30 to the second end 32 is a simple curve with a constant radius. In another aspect, the curvature of the exterior surface 40 extending from the first end 30 to the second end 32 is a complex curve with a plurality of different radii. In a further aspect, the curvature of the interior and exterior surfaces remains relatively constant as wall 24 circumscribes the hollow cavity 26. In one aspect, in which the curvature of the exterior surface 40 satisfies a definition for a catenary curve, the tubular body 22 might form a catenoid. In another aspect, the tubular body 22 might form a helicoid.

The configuration of the exterior surface 40, including various qualities such as size and shape, might be determined or defined in other manners. In one aspect of the present disclosure, the exterior surface of the support structure 20 is a minimal surface. In general, a minimal surface includes a zero mean curvature, and a minimal surface may be defined by an equation. Among other things, by using a minimal-surface geometry with curved surfaces for the support structure, force load applied to the support structure 20 might be more evenly distributed throughout the continuous surface of the entire system, as opposed to greater axial distribution that might otherwise occur, such as with struts that intersect one another. In a further aspect, an equation "E1" defining the minimal surface of the exterior surface 40 includes:

$$\sin(x)*\sin(y)+\cos(y)*\cos(z)=0$$

In an aspect of this disclosure, the elements of the support structure 20, such as dimensions and configuration (e.g., curvature of wall), affect the contribution of the support structure to the cushioning functionality of a footwear sole. For example, the dimensions and configuration might affect the rate and consistency at which the support structure 20 compresses under load. Furthermore, the dimensions and configuration might affect the amount of force at which the support structure 20 undergoes an increased rate of compression, similar to a collapsing action, or bottoming out. For example, the omission of flat or planar surfaces, as well as corners, joints, and junctions in the support structure 20, might reduce the likelihood that a compression force will be focused on a fewer number of positions when the support structure is under load, and in this respect, a compression force may be more evenly distributed throughout the entire support structure 20. For example, when a configuration of the exterior surface is a minimal surface, the force-load might be distributed across the entire area of the surface as opposed to a strut-based surface in which the force-load may concentrate in the cross sections of the strut. Among other things, a strut-based system may experience failure in the structure due to repeated bending of the strut elements at positions that bear a larger portion of the force-load.

In another aspect, the structure of the support structure 20 factors into the ability of the support structure 20 to be coupled with other support structures, in a manner that allows the combination of support structures to also contribute to the cushioning functionality. In these respects, the support structure 20 includes features and elements as a basic unit or cell that are important to the functionality of a system as a whole (e.g., system of support structures in a footwear sole), and some of the subsequent aspects of this disclosure will provide additional explanation as to how a system of support structures may contribute to the footwear-sole functionality. For example, referring to FIGS. 12, 13A-13C, 14, and 15A-15D, any and all examples described with respect to the support structure 20 can apply to support structures associated with the footwear article 1210, 1410, or 1510 and/or associated with the cartridge 1224 (e.g., any support structure that is enclosed by an exoskeleton).

Figure 4:
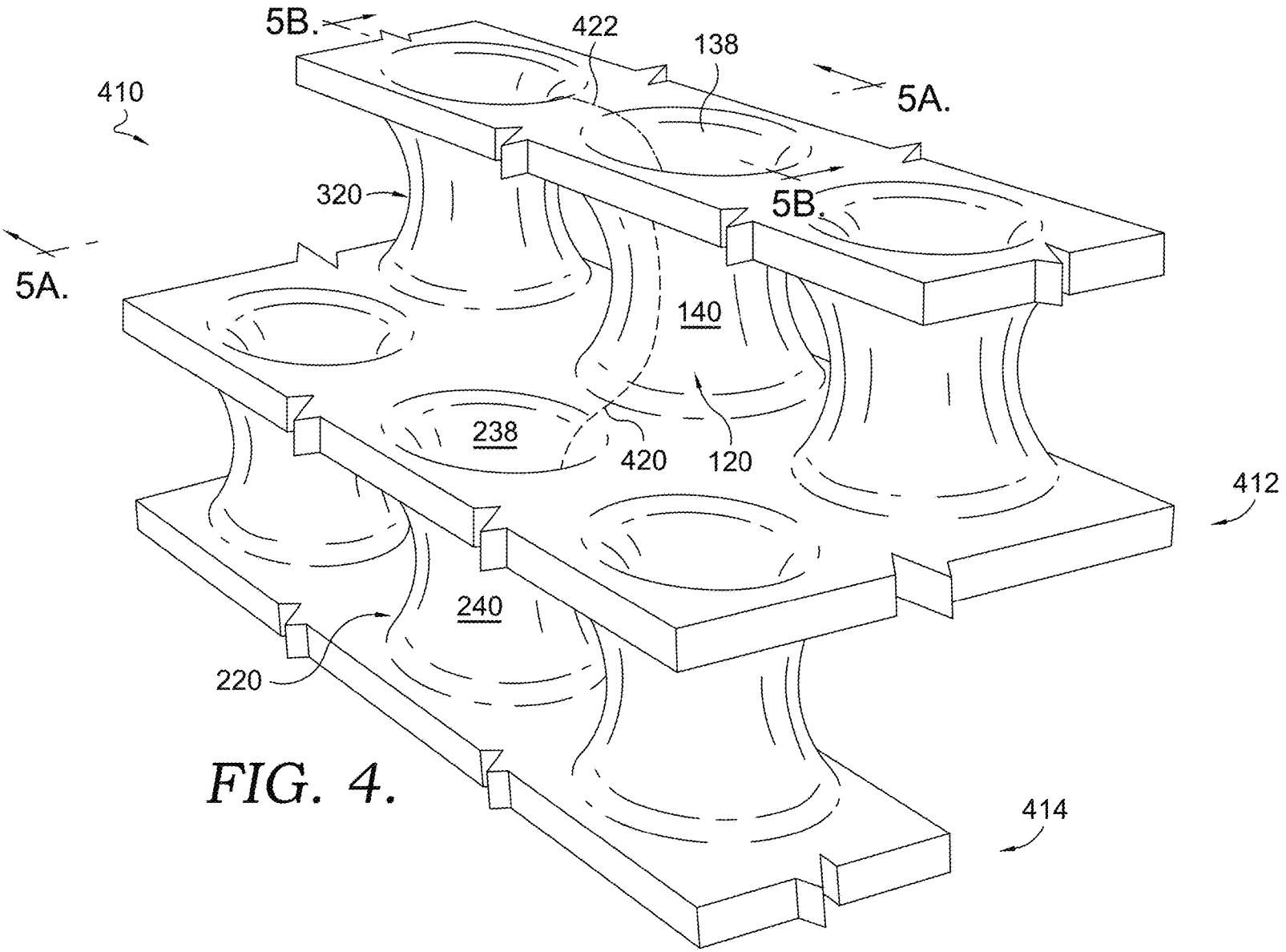
FIG. 4 depicts a first system of support structures in accordance with an aspect of this disclosure.

The support structure 20 may be coupled to one or more other similarly shaped support structures in a support-structure system, which might be configured for integration into a footwear sole. The system of support structures might be organized into various arrangements of rows, columns, matrices, arrays, and the like. For example, referring to FIG. 4, a system 410 of support structures is depicted including a first support structure 120, a second support structure 220, and a third support structure 320. The first support structure 120 and the third support structure 320 are positioned in a same row 412 of support structures, whereas the second support structure 220 is positioned in a second row 414 that is staggered relative to the first row 412. For illustrative purposes, FIG. 5A depicts a cross-sectional view taken at reference plane 5A-5A identified in FIG. 4, and FIG. 5B depicts a cross-sectional view taken at reference plane 5B-5B identified in FIG. 4.

Figure 5A:
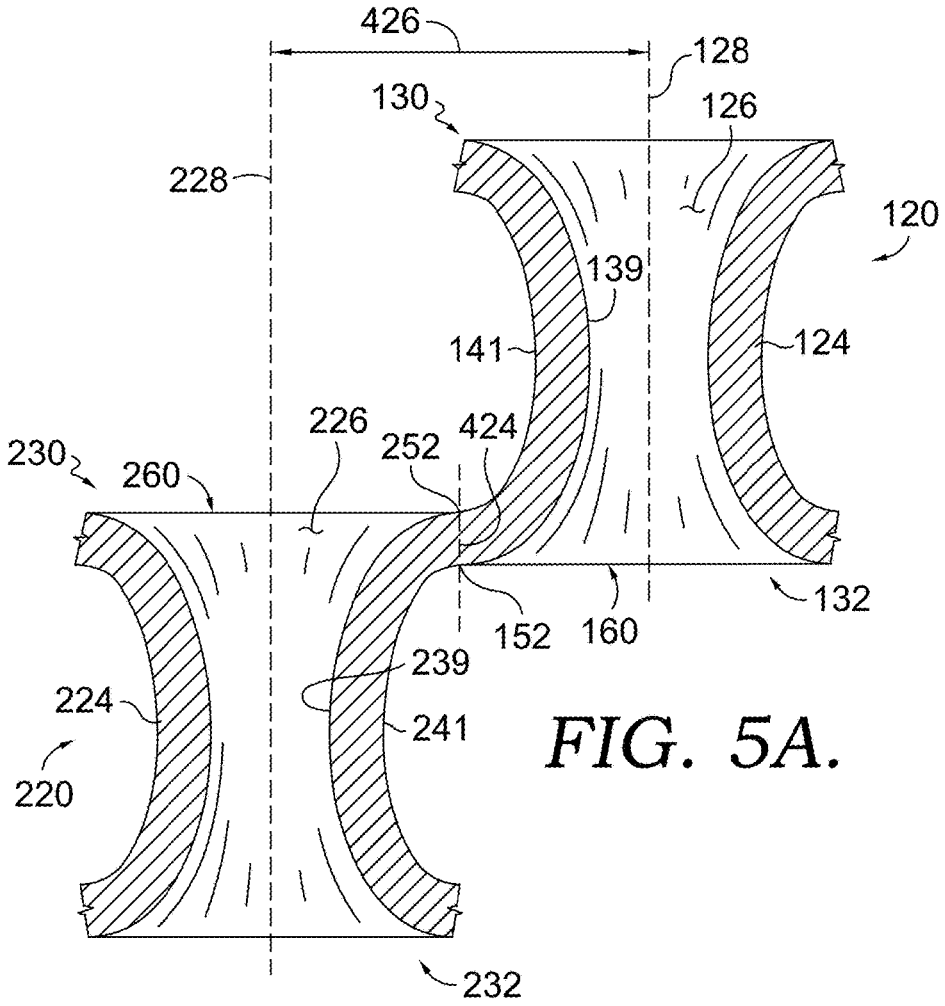
FIGS. 5A and 5B depict different cross-sectional views of the system in FIG. 4 in accordance with an aspect of this disclosure.
Figure 5B:
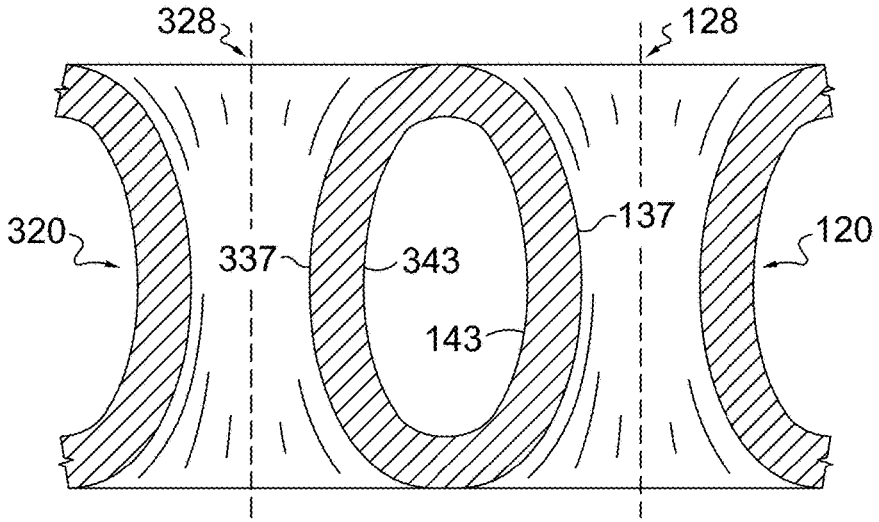

As illustrated in the cross-section depicted in FIG. 5A, the axis 128 of the first support structure 120 in the first row 412 is not coaxial along a common axis with the axis 228 of the second support structure 220 in the second row 414. In this sense, the axis 128 is laterally (or horizontally) offset from the axis 228 (i.e., laterally being opposite or perpendicular to the general longitudinal orientation of the axis). The first and second support structures 120 and 220 are also laterally offset from one another. In addition, the first and second support structures 120 and 220 themselves are longitudinally (or vertically) offset, in the longitudinal direction of the axes. As used herein, the term vertical or vertically refers only to the up-and-down orientation relative to the depiction of FIG. 5A on the page, and vertically does not necessarily refer to the orientation when the support structures 120 and 220 are integrated into a footwear sole. In addition, horizontal or horizontally refers only to the side-to-side orientation relative to the depiction of FIG. 5A on the page and does not necessarily refer to the orientation when the support structures 120 and 220 are integrated into a footwear sole.

The relationship between the first support structure 120 and the second support structure 220 may include additional features or characteristics relating to, and contributing to, at least a portion of the system 410. Furthermore, both the first support structure 120 and the second support structure 220 may include elements consistent with the support structure 20 described in relation to FIGS. 2, 3A, and 3B, and some of these elements are identified in FIGS. 4 and 5A. As such, the first support structure 120 and the second support structure 220 may each include a tubular body including a wall 124 and 224 that at least partially encloses a hollow cavity 126 and 226 and that extends circumferentially around the hollow cavity and the reference axis 128 and 228. In addition, the tubular body of each of the first support structure 120 and the second support structure 220 may include a first end 130 and 230 and a second end 132 and 232 that are spaced apart in an axial direction. Furthermore, the wall 124 and 224 of each of the support structures may curve inward as the wall extends between the first end and the second end, and the wall may include an exterior surface 140 and 240 facing away from the hollow cavity and an interior surface 138 and 238 facing towards the hollow cavity. The support structures 120 and 220 may include any of the additional elements described with respect to FIGS. 2, 3A, and 3B, either independently of one another, or collectively.

As described above, the rows 412 and 414 are staggered, being laterally offset and arranged end-to-end. Accordingly, in one aspect (as illustratively depicted in the cross section of FIG. 5A), the first support structure 120 is partially stacked atop, and staggered relative to, the second support structure 220. Furthermore, one or more surfaces continuously extend from the first support structure 120 to the second support structure 220 to construct respective surface portions of each structure's tubular wall. For example, the dashed reference line 420 (FIG. 4) is illustrated on a single continuous surface including both a first portion of the exterior surface 140 of the first support structure 120 and a first portion of the interior surface 238 of the second support structure 220. In this manner, the dashed reference line 420 illustrates a manner in which the single continuous surface transitions from an exterior surface 140 of one support structure 120 to an interior surface 238 of another support structure 220. In a complimentary manner on an opposite side of the walls 124 and 224 (obscured from view in FIG. 4), a single surface continuously forms, and extends from, the interior surface 138 of the support structure 120 to the exterior surface 240 of support structure 220.

These aspects are also illustrated in the cross section depicted in FIG. 5A, and the reference plane at which the cross section 5A-5A is taken is aligned with the reference line 420. As such, FIG. 5A illustrates a first exterior-surface portion 141 of the first support structure 120 that is continuous with a first interior-surface portion 239 of the second support structure 220. Furthermore, the first exterior-surface portion 141 includes a concave curvature extending between the first end 130 and the second end 132, and the first interior-surface portion 239 includes a convex curvature extending between the first end 230 and the second end 232. As explained above, the single continuous surface transitions from the exterior-surface portion 141 to the interior-surface portion 239. In a complimentary manner, FIG. 5A illustrates an interior-surface portion 139 (convex as it extends between the first end 130 and the second end 132) of the first support structure 120 being continuous with an exterior-surface portion 241 (concave as it extends between the first end 230 and the second end 232) of the second support structure 220.

In one aspect of the disclosure, the first support structure 120 has a second-end rim 160, including a circumferential portion of the interior surface 138, and an edge of the second-end rim 160 abuts a junction 152 with the exterior-surface portion 241 (i.e., the portion at which the interior-surface portion 139 transitions to the exterior-surface portion 241). In addition, the second support structure 220 includes a first-end rim 260, including a circumferential portion of the interior surface 238, and an edge of the first-end rim 260 abuts a junction 252 with the exterior-surface portion 141 (i.e., the portion at which the interior-surface portion 239 transitions to the exterior-surface portion 141). As explained with reference to FIG. 2, the second-end rim 160 and the first-end rim 260 each includes a respective diameter. In a further aspect of the disclosure, the axis 128 and 228 of the first support structure 120 and the second support structure 220 are offset by a distance 426 that is equal to an average of the diameters of the second-end rim 160 and the first-end rim 260. Moreover, the junctions 152 and 252 might be directly opposite one another on either side of the wall in a plane 424 running parallel with both axis.

The junction (e.g., 152 or 353), or the point at which one surface transitions to another surface (e.g., the point at which exterior portion 141 transitions to interior portion 239), might be identified in a various manners. For example, in one aspect of this disclosure, the transition point is located at the position at which a concave exterior surface changes to a convex interior surface. In another aspect, the transition point is located at the position at which a convex interior surface changes to a concave exterior surface. In other aspects, a flat surface may extend between and connect a concave surface and a convex surface, and in that instance, the junction (i.e., transition point) is at the midpoint between the convex surface and the concave surface.

As explained in other portions of this disclosure, the exterior surface of the support structures might include a minimal surface. Among other things, a minimal-surface geometry may help distribute a load more evenly throughout the entire system 410—such as a load applied generally in the axial direction or otherwise. Accordingly, in one aspect the exterior surfaces 140 and 240, including the portions 141 and 241, might both include portions of a minimal-surface structure. For example, the exterior surfaces 140 and 240 of both support structures 120 and 220 might include a catenoid or a helicoid. In one aspect, the exterior surfaces are defined by the equation E1. Furthermore, as explained above, the structure of the support structure 20 factors into the ability of the support structure 20 to be coupled with other support structures, in a manner that allows the combination of support structures to also contribute to the cushioning functionality. This aspect is at least partially illustrated by the reference line 420 showing the continuous surface that smoothly transitions from one support structure 120 to another support structure 220. This aspect is also illustrated by the cross-sectional view of FIG. 5A showing the smooth transition from the wall 124 to the wall 224. The smooth transition minimizes corners or other wall junctions that might otherwise create unequal load distribution. That is, this continuous and smooth transition between support structures helps to reduce the likelihood that a compression force will be focused at fewer locations (e.g., wall joints) and to allow the compression force to be more evenly distributed throughout the entire system of support structures.

FIGS. 4 and 5B also help to show a relationship between the first support structure 120 and the third support structure 320, which are arranged side-by-side, such that the axes 128 and 328 are laterally (or horizontally) offset and are not coaxial along the same axis. But the structures 120 and 320 themselves are not longitudinally or vertically offset from one another or stacked in and end-to-end manner. That is, as between the structures 120 and 320, the rims of at least one of the structures lie in respective planes that are either aligned with a rim of the other structure or are between the rims of the other structure. Support structures that are not laterally axially aligned have axes that are either parallel or skew and are not coaxial.

The third support structure 320 might likewise include the elements described with respect to FIG. 2, such as a wall, first end, second end, interior surface, exterior surface, wall thickness, height, curvature, etc. Furthermore, one or more surfaces continuously extend from the first support structure 120 to the third support structure 320 to construct respective surface portions of each structure's tubular wall. For example, the dashed reference line 422 is illustrated on a single continuous surface and is aligned with the reference plane 5B-5B. FIG. 5B illustrates a second exterior-surface portion 143 of the first support structure 120 that is continuous with an exterior-surface portion 343 of the third support structure 320. Furthermore, the exterior-surface portions 143 and 343 form a continuous closed chain as the continuous surface extends from the first support structure 120 to the third support structure 320, back to the first support structure 120, and so on. FIG. 5B also illustrates a second interior-surface portion 137 (also illustrated by a reference line in FIG. 5A) of the first support structure 120 that is continuous with an interior-surface portion 337 of the third support structure 320. The interior-surface portions 137 and 337 form a continuous closed chain as the continuous surface extends from the first support structure 120 to the third support structure 320, back to the first support structure 120, and so on.

Similar to the explanation of the relationship between the support structures 120 and 220, the continuous surface of 143 and 343 and of 137 and 337 smoothly transitions from one support structure 120 to another support structure 320. The smooth transition minimizes corners or other wall junctions that might otherwise absorb more of a force. That is, this continuous and smooth transition between support structures helps to reduce the likelihood that a compression force will be focused at fewer locations and to allow the compression force to be more evenly distributed throughout the entire system of support structures.

Figure 6A:
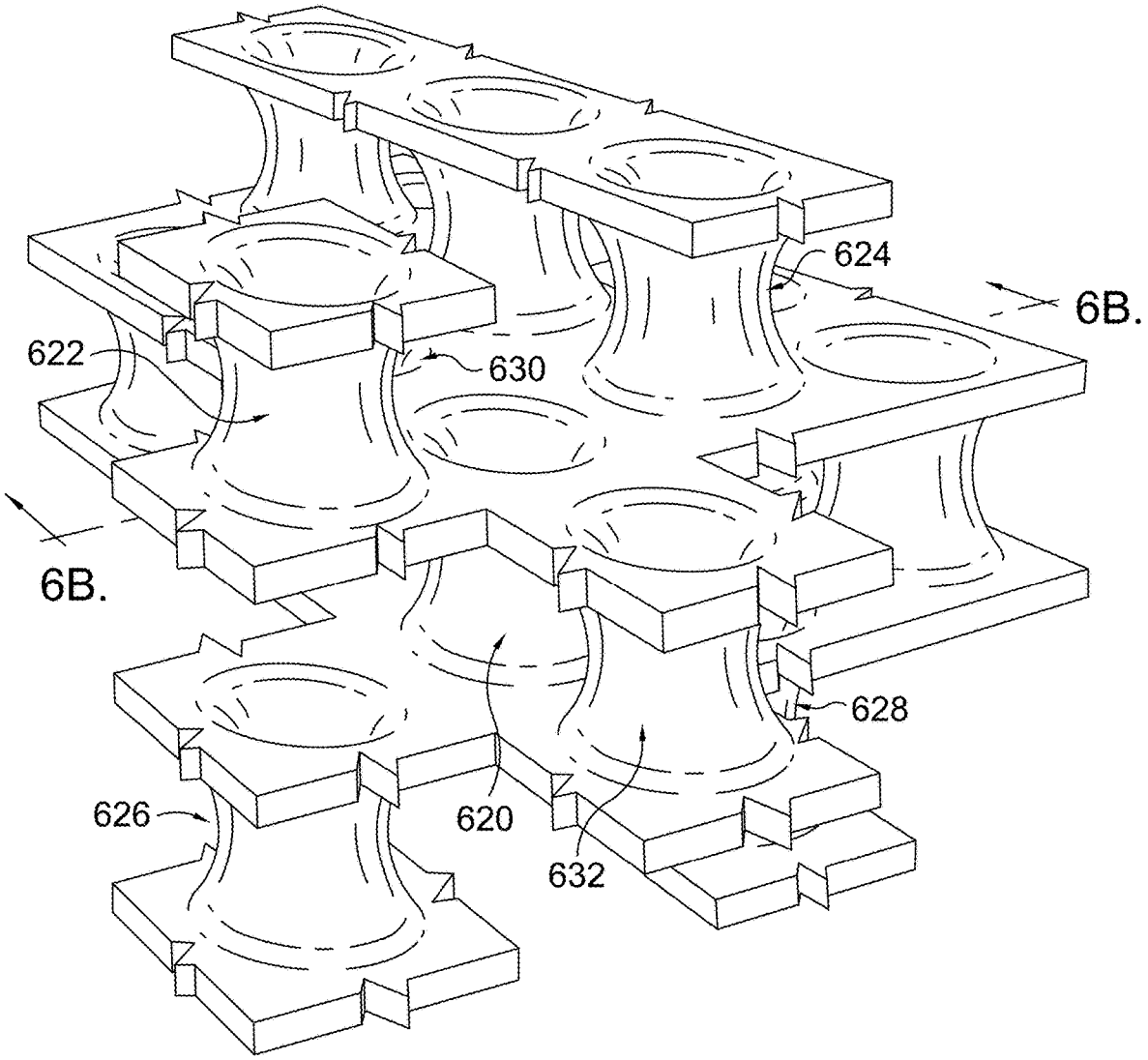
FIG. 6A depicts a second system of support structures in accordance with an aspect of this disclosure.
Figure 6B:
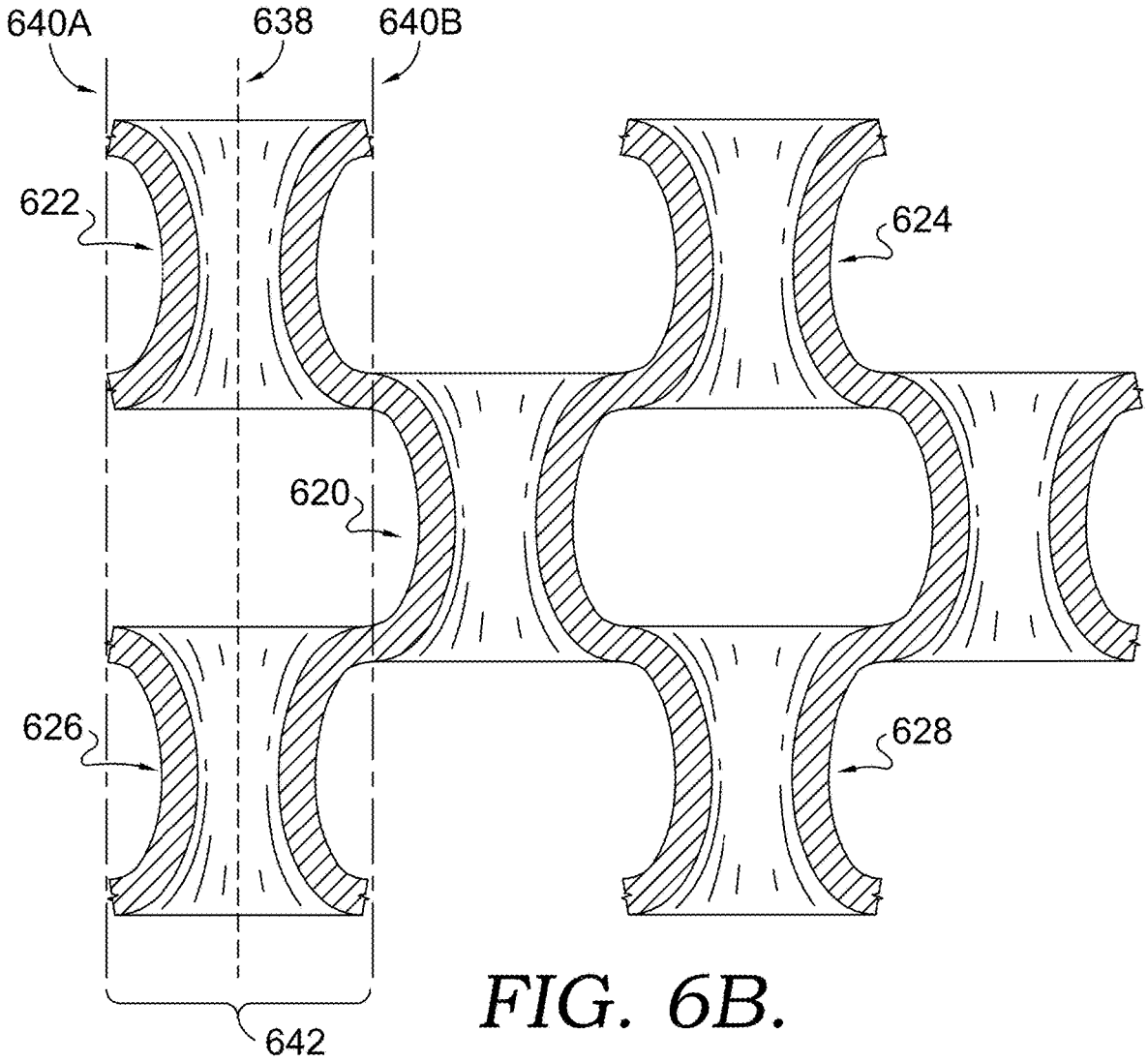
FIG. 6B depicts a cross-sectional view of the system in FIG. 6A in accordance with an aspect of this disclosure.

A system of support structures may be built out even further, and FIG. 6A illustrates another aspect in which additional rows 612 and 614 of support structures have been added to the system 410. (It should be noted that the break lines on the edges of the walls illustrate that the system might be expanded out further with additional support structures adding to the illustrated matrix.) In addition, FIG. 6B illustrates a cross-sectional view showing a relationship between some of the support structures, and illustrating that continuous surfaces may transition from one support structure to another, similar to the manner described in FIGS. 4, 5A, and 5B. Consistent with one aspect of this disclosure, FIG. 6A illustrates that a support structure may have continuous surfaces with at least six other support structures. For example, in FIG. 6B the support structure 620 includes an end-to-end, staggered arrangement with the support structures 622, 624, 626, and 628, and in FIG. 6A the support structure 620 includes a side-by-side relationship with the support structures 630 and 632. It should be noted that the term "stacked" may refer to an end-to-end arrangement, and in FIG. 6B, the support structures 620, 622, and 624 are illustrated on the drawing page as stacked on, and supported by, the support structures 626 and 628. In other aspects, the orientation of the entire system might be rotated clockwise or counterclockwise when integrated into another article, such as a footwear sole, in which case the support structures might still be stacked in a sense of being end-to-end. For example, the support structure 622 and the support structure 620 are end-to-end with one another, and are laterally staggered (e.g., laterally being opposite to the longitudinal orientations of axes).

FIG. 6B illustrates other structural aspects of the system of support structures. For example, some support structures in different rows are coaxial—in other words, the reference axis of a first support structure is aligned with the reference axis of a second support structure along a common axis. For example, the reference axis of the support structure 622 and the reference axis of the support structure 626 are aligned along a common axis 638. These coaxial support structures form columns of spaced apart, coaxial support structures (e.g., they are spaced apart by the staggered, interleaving rows of support structures). For instance, the support structure 622 is spaced apart from the support structure 626 by the staggered, interleaving support structure 620, and reference lines 640A and 640B are provided in FIG. 6B to delineate an example column 642. Support structures arranged in columns may also be referred to as "axially aligned," which describes two or more support structures that are aligned longitudinally (e.g., along the longitudinal orientation of the axis), sequentially (not concentrically) along a common axis, such that the axes of the axially aligned support structures are substantially coaxial.

As explained in other portions of this disclosure, the exterior surface of the support structures 620, 622, 624, 626, 628, 630, and 632 might include a minimal surface. For example, the exterior surfaces the support structures 620, 622, 624, 626, 628, 630, and 632 might include a catenoid or helicoid. In addition, the exterior surfaces might be defined by the equation E1. Among other things, as explained above a minimal-surface geometry may help distribute a load more evenly throughout the entire system 610. In addition, the structure of the individual support structures contributes to each structures ability to connect with adjacent structures in a manner that minimizes high pressure or higher load bearing points.

In an additional aspect of the present invention, a system of support structures is built out across various portions of a footwear sole. For example, the system 610 of FIG. 6 may be extrapolated out from the medial side to the lateral side and from the heel region to the forefoot region to form at least a portion of the sole structure 12 of FIG. 1. In addition, the system 610 might be extrapolated out and only selectively positioned in different parts of a footwear sole. For example, the extrapolated system might be selectively positioned in the forefoot, the midfoot, the heel, the lateral side, the medial side, any portion of the foregoing, and any combination thereof. Referring briefly to FIGS. 12, 13A-13C, 14, and 15A-15D any and all examples described with respect to the system 410 or the system 610 can apply to components of the footwear article 1210 or 1410 and/or associated with the cartridge 1224 (e.g., any system of support structures that is enclosed by an exoskeleton).

A support structure or a system of support structures may have various elements and operations in the context of a footwear sole. For example, in FIG. 1 the footwear sole 12 includes a ground-contacting outsole having two or more ground-contacting surfaces (when the outsole is at rest on a ground surface) positioned in a reference plane 13. In one aspect of the present disclosure, the reference axis of one or more support structures included in the sole (e.g., reference axis 28 of support structure 20) is inclined towards the heel region 18. In other words, the support structure 20 includes a superior end 21 and an inferior end 23, and the superior end 21 is positioned closer to the heel region 18 than the inferior end 23. In addition, the superior end is farther from the outsole than the inferior end 21. As such, in FIG. 1, the reference axis 28 intersects the reference plane 13 at an angle 29 in a range of about 30 degrees to about 60 degrees. In a further aspect, the reference axis intersects the reference plane 13 at an angle 29 of 45 degrees. In other aspects of the disclosure, the angle 29 may be smaller or larger than this range. For example, the angle 29 may be perpendicular to the reference plane 13, or the axis may incline towards the forefoot. The angular orientation of the support structures relative to the ground-contacting surface may, in some aspects, provide an alignment with a direction of a ground force that contributes to an amount of cushioning and responsiveness.

In an aspect of this disclosure, independent support structures, and a system as a whole might compress in various manners when a load is applied. For example, in some aspects, the walls of each support structure fold, bend, or collapse, and this change in state by the walls absorbs at least part of the load (i.e., provides some load attenuation). In addition, the arrangement of the support structures into a system might contribute to the function of the system as a whole. For example, the arrangement of the support structures into a system of continuous surfaces might contribute to a more gradual, even, smooth structure-by-structure collapse as a force is transferred from one part of the system to another. Stated in another way, when a ground force is applied to a first support structure in the system (e.g., foot strike when running), a connected second support structure becomes primed for a gradual collapse, since the continuous surface between the first and second support structures transfers some of the initial force from the first support structure to the second support structure. This continuous surface, and the resulting gradual and relatively linear transfer of force, creates a domino effect from one support structure to the next, which might result in a more even collapse across the system as a whole, as compared with other cell-based or lattice-based systems. In this sense a system of support structures is at least partially a metamaterial, such that the impact-attenuation functionality is derived from characteristics other than the underlying material (e.g., EVA or TPU).

Furthermore, the characteristics of the underlying material may also contribute to the impact-attenuation functionality, and this is described in more detail below. For example, the walls themselves may compress, such that the walls reduce in size under load from a first thickness to a smaller second thickness, to provide additional load attenuation. This aspect of the disclosure in which sole functionality is derived from both the configuration of the support structure(s) and the underlying material might be different from some other footwear soles in which a greater amount of the sole functionality, such as cushioning, is derived from the underlying material (e.g., solid foamed midsoles). By configuring the support structures in a manner that also contributes to sole functionality, such as with even load distribution at least partially attributable to wall configuration, an aspect of this disclosure having the matrix of support structures spaced apart provides a lighter sole as compared with a solid foam midsole.

Various previous portions of this disclosure have described aspects of the support structures and the systems of support structures that contribute to cushioning functionality in a footwear sole while a force is applied. This cushioning functionality is at least partially related to the configuration or shape of the support structures, and some additional aspects of this disclosure are related to methods and materials for making a system of support structures. For example, various different manufacturing techniques and materials may be used, and some techniques and materials may provide confer different traits and qualities to the manufactured support structure.

In one aspect of the present disclosure, a system of support structures is manufactured using a 3D additive-manufacturing technique. In some instances, 3D additive-manufacturing techniques might be better suited than some other manufacturing techniques, such as injection molding or casting, for manufacturing articles having certain geometries. For example, it might be more difficult to construct a system of support structures (e.g., FIGS. 4 and 6A) using injection molding than executing a 3D additive-manufacturing process. Various 3D additive-manufacturing techniques might be used to construct a system of support structures. For example, in one instance a system of support structures might be constructed using selective laser sintering (SLS) or stereolithography (SLA). In another aspect, a system of support structures might be manufactured using a multi-jet fusion technique. Each of these techniques might be optimized based on the material being used, geometry and wall thickness of the part, and target traits for the part, such as by tuning the initial temperature of the machine or material bed and the method and delivery of energy used to bind the base material. For example, when executing a multi-jet fusion technology, each of the steps might be adjusted based on a base material, including the temperature of the material bed and base material, fusing-ink type, fusing-ink temperature, type of energy or heat applied, amount of energy of heat applied, number of fusing-ink passes, speed of fusing-ink pass, and the like.

In one aspect of the disclosure, a system of support structures is manufactured by a 3D additive-manufacturing technique with a base material, and the base material includes a rebound-resilience material property that contributes to the functionality of the system of support structures in a footwear sole. For instance, in one aspect of the present disclosure, the support structures are constructed of a base material having high rebound and being highly resilient. High rebound may be defined as a rebound value of at least a 50%. And in other aspects, the rebound percentage is higher, and may be at least 60%. In a further aspect still, the rebound percentage may be at least 65%. Rebound percentage may be tested using various techniques, such as by using a Schob pendulum or other type of tup or ram. Furthermore, the rebound resilience property of a material might relate to footwear-sole performance in various ways. For example, as described above, the configuration of the individual support structures and the system of support structures contributes to the cushioning functionality and the rebound resilience of the base material might contribute to the energy-return functionality. In other words, the configuration of the individual support structures and the system of support structures might at least partially determine the rate and force at which the sole compresses, and the rebound resilience might at least partially determine the recovery of the sole as the force is withdrawn or removed (e.g., when a foot is pulled or lifted off the ground).

The system of support structures may be constructed of various materials having a rebound resilience that contributes to the energy-return functionality. For example, in one aspect, the system of support structures is constructed of a thermoplastic polyurethane (TPU) having a rebound percentage of at least 50%. In another aspect, the TPU has a rebound percentage of at least 60%. And in a further aspect, the TPU has a rebound percentage of at least 65%. As explained above, a system of support structures might be manufactured using a multi-jet fusion technique, and in one aspect of this disclosure, the technique is tailored to the TPU base material. For example, various steps in the multi-jet fusion technique are tailored to the TPU, including the initial temperature of the base material or material bed before fusing, the fusing-ink type, fusing-ink temperature, type of energy or heat applied, amount of energy of heat applied, number of fusing-ink passes, speed of fusing-ink pass, or any combination thereof.

In a further aspect of this disclosure, the support structures may be tuned across the various zones of the footwear sole to achieve an amount of cushioning and responsiveness. For example, the support structures in the sole 12 might include a consistent wall thickness, height, and angular orientation across all parts of the sole. In another aspect, each of these elements may be varied independently, collectively, and in any combination across different zones or regions of the footwear sole. For example, the wall thickness of a support structure may gradually change from one region of a sole to another region of a sole. In one illustrative aspect, a heel region of a sole includes support structures having a wall thickness of about 0.90 mm; a forefoot region includes support structures having a wall thickness of about 1.15 mm; and the support structures therebetween gradually increase in wall thickness from 0.90 mm to 1.15 mm. This is just one example of how support structure features may vary across a sole. In other instances, a heel region might include support structures with thicker walls, relative to the wall thickness of support structures in the forefoot. Likewise, a medial side might include support structures with different characteristics than a lateral side. Various other qualities may also be tuned across a system of support structures, such as the matrix structure, material, and addition of another material to fill in gaps between support structures and/or the hollow cavities among the support structures.

In another aspect support-structure dimensions may be tuned based on various factors. For example, a wall thicknesses may be increased in one or more regions of a sole for wearers that create greater force when contacting a ground surface, due to body weight, activity, running form, and the like. In another example, wall thickness may be tuned to either complement or correct a wearer's running gait, stride, foot strike (e.g., degree of pronation). As such, in accordance with an aspect of this disclosure, a sole having a system of support structures may be customized for a particular wearer based on shoe size, body weight, activity type, movement biomechanics, desired level of cushion, desired level of responsiveness, or any combination thereof. Aspects of this disclosure are particularly well suited for customization based on the ability to implement changes in a footwear sole that are humanly perceptible (based at least on subjective feedback) by making relatively small changes to the support-structure dimensions. For example, testing shows that some users wearing footwear, which has a sole constructed using the support structures described in this disclosure, can subjectively detect as small as a 0.05 mm change in support-structure wall thickness (e.g., change in the feel of the cushion or of the responsiveness). As used herein, the term "movement biomechanics" describes the quantitative and qualitative categorization of the plurality of positions of a wearer's body at each stage of a movement, including running, walking, and jumping. In addition to tuning the individual support structures, the overall configuration of a midsole may be tuned according to the above described factors. For instance, a heel region may be thicker than other regions of the midsole. In other aspects, a lateral and/or medial peripheral portion may be thicker than more centrally located zones.

FIGS. 7A-C, 8A-C, and 10A-C each depict different sole structures in accordance with aspects of this disclosure. In one aspect, various programming techniques may be utilized to create a sole structure, such as those depicted in FIGS. 7A-C, 8A-C, and 10A-C. For example, the computer-aided design applications sold under the trademarks Rhinoceros® or Grasshopper®, or other visual programming tools or languages, may be used, in which case an explicit definition might be created to define the minimal surface of the support-structure exterior surface. (The Rhinoceros® and Grasshopper® computer-aided design applications are available from, and the Rhinoceros® and Grasshopper® trademarks are the property of, TLM, Inc., doing business as Robert McNeel & Associates of Seattle, WA.) That is, an explicit Grasshopper® definition may be created that can be used to create a support structure having a minimal-surface equation, such as E1. Using that Grasshopper® definition, various other parameters might be specified, such as wall thickness, sole perimeter shape, sole thickness, sole size, sole foot-bed topography, and sole outsole topography. With the parameters, the Grasshopper® definition can conform the support structures to the defined surfaces and populate the space or envelope therebetween. In a further aspect, the explicit definition is customizable based on various factors, such as by adjusting wall thickness, support-structure height, axis orientation, and the like.

Figure 7A:
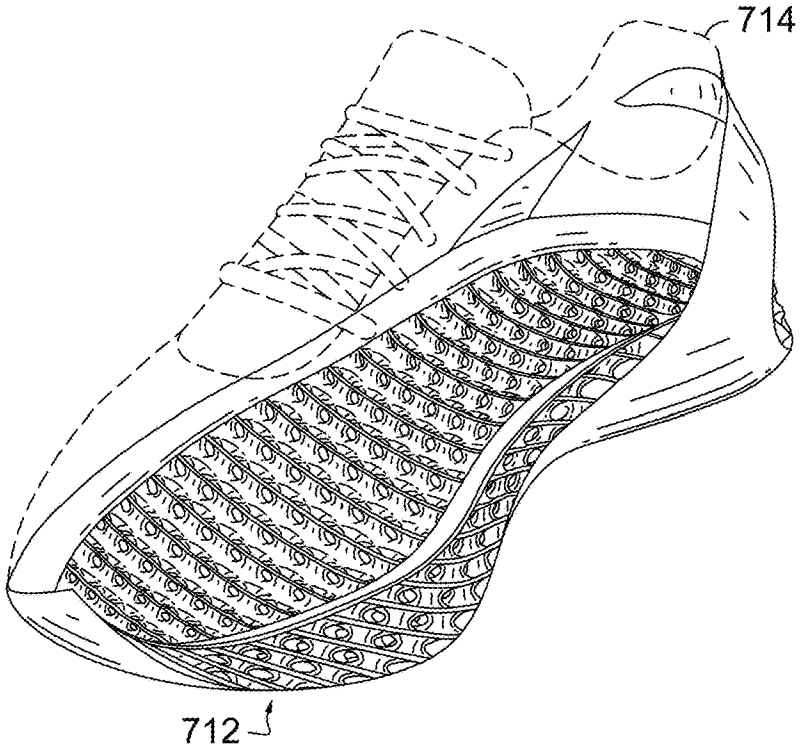
FIGS. 7A, 7B, and 7C each depicts a respective view of a footwear article in accordance with an aspect of this disclosure.
Figure 7B:
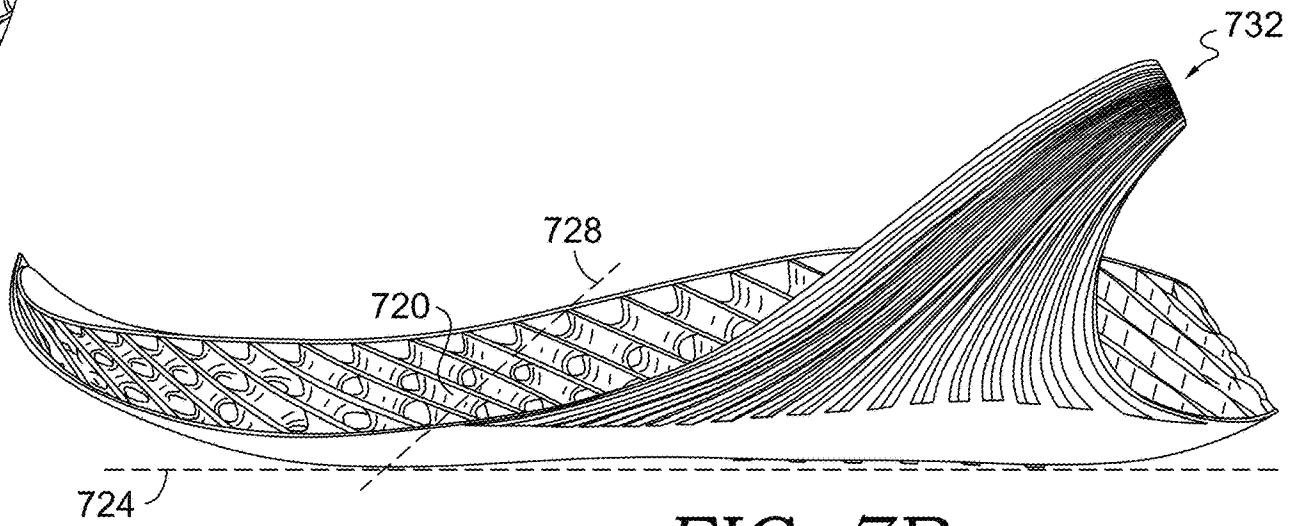
Figure 7C:
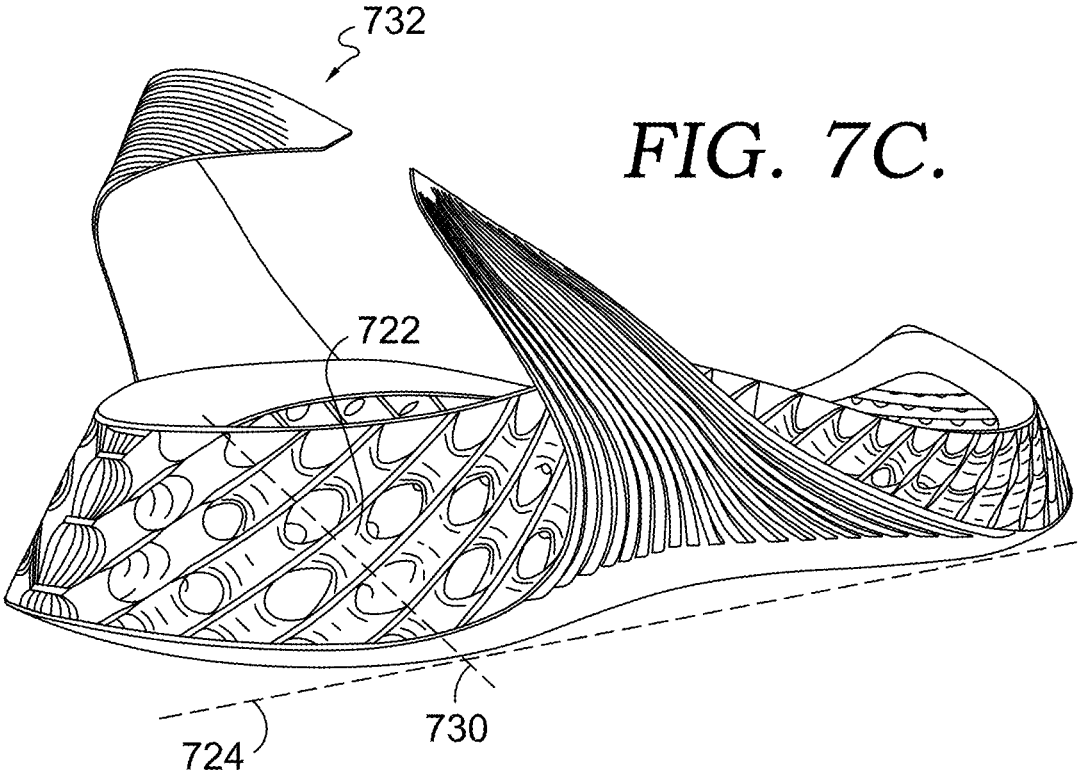

FIG. 7A-7C include a sole 712 having a system of support structures (e.g., 720 and 722), and at least some of the support structures include features similar to those described with respect to the support structure 20 of FIG. 2. For example, the support structures constructing the sole 712 may include tubular bodies having inwardly curving walls. In another aspect, the exterior surfaces of the inwardly curving walls may be defined by a minimal-surface equation, such as E1. In a further aspect, a ground-contacting outsole of the sole 712 includes two or more surfaces positioned in a reference plane 724, and the support structures may include a reference axis 728 and 730 that is angled relative to the reference plane. The sole 712 may include a system of support structures similar to the system 610 described with respect to FIG. 6. For example, continuous surfaces may transition from one support structure to adjacent support structures in a manner that might contribute to even distribution of force load and load attenuation. For the sake of brevity, all of the features of the support structures described with respect to FIGS. 1-6B are not reiterated here, but it is understood that the support structures and system of support structures of the sole 712 may include all of those features.

Furthermore, as an alternative to the system 610, the sole 712 may include support structures 720 and 722 having respective axis that are not parallel with one another and that are skew (relative to one another), but that have a similar angle with respect to the reference plane 724. The orientation of the axis is another characteristic that may be adjusted, customized, or tuned based on a particular wearer. In an additional aspect of the disclosure, a first region of the sole 712 may include support structures with axis in a first orientation; a second region of the sole 712 may include support structures with axis in a second orientation that is different from the first orientation; and the axis orientation of support structures between the first and second regions may gradually change from the first orientation to the second orientation.

In a further aspect, the sole 712 includes a heel strap 732 that is coupled to the sole 712 and that extends around the back of the upper 714. The heel strap 730 may be integrally formed (e.g., 3D printed, molded, cast, etc.) with the sole 712 or may be affixed after the sole 712 is formed, such as by using an adhesive. Among other things, the strap may provide additional stability, fit, durability, and the like.

Figure 8A:
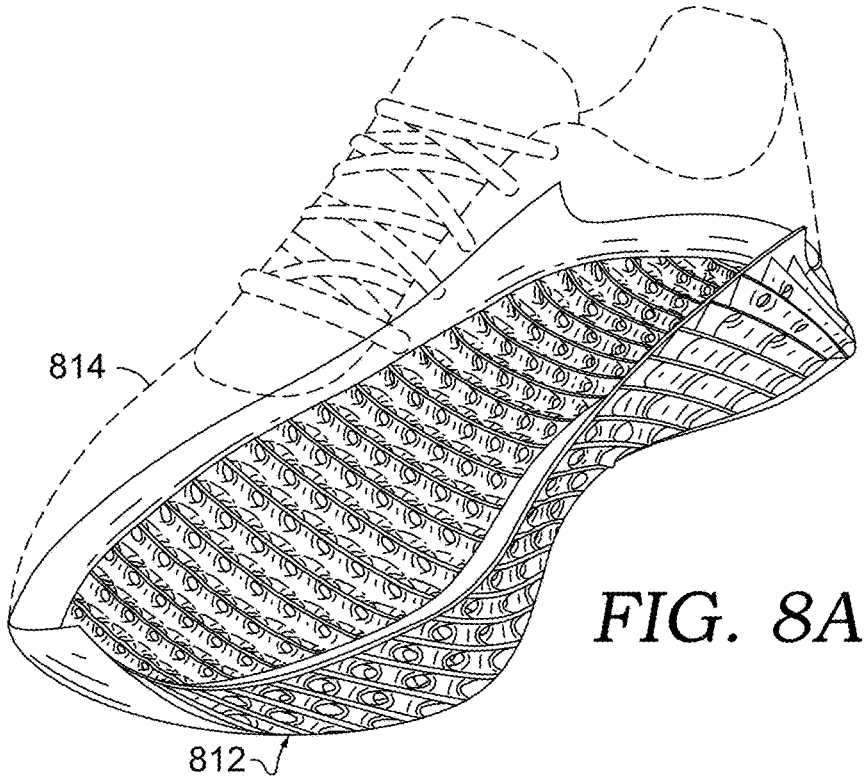
FIGS. 8A, 8B, and 8C each depicts a respective view of a footwear article in accordance with an aspect of this disclosure.
Figure 8C:
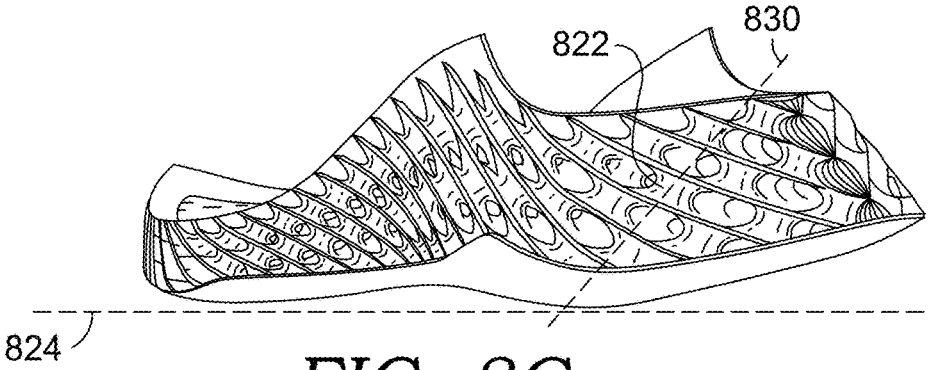
Figure 8B:
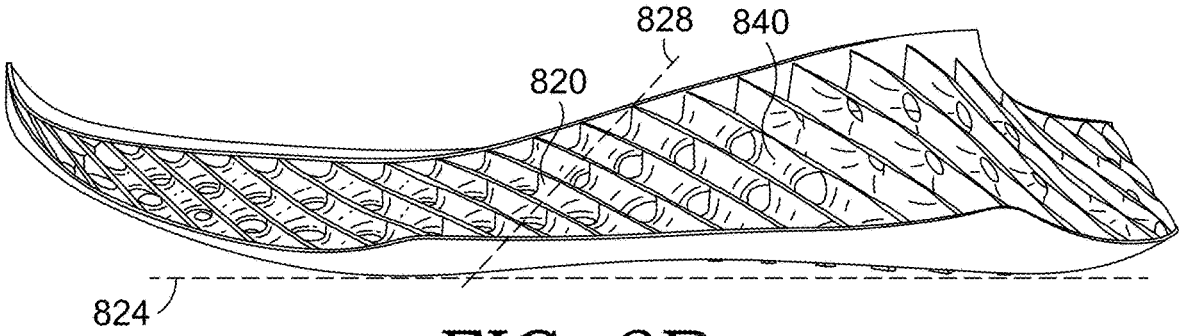

FIGS. 8A-8C includes a sole 812 having a system of support structures (e.g., 820 and 822), and at least some of the support structures include features similar to those described with respect to the support structure 20 of FIG. 2. For example, the support structures constructing the sole 812 may include tubular bodies having inwardly curving walls. In another aspect, the exterior surfaces of the inwardly curving walls may be defined by a minimal-surface equation, such as E1. In a further aspect, a ground-contacting outsole of the sole 812 includes two or more surfaces positioned in a reference plane 824, and the support structures may include a reference axis 828 and 830 that is angled relative to the reference plane. The sole 812 may include a system of support structures similar to the system 610 described with respect to FIG. 6. For example, continuous surfaces may transition from one support structure to adjacent support structures in a manner that might contribute even distribution force load and load attenuation. For the sake of brevity, all of the features of the support structures described with respect to FIGS. 1-6B are not reiterated here, but it is understood that the support structures and system of support structures of the sole 812 may include all of those features.

Similar to the sole 712, the sole 812 may include support structures 820 and 822 having respective axis that are not parallel with one another and that are skew (relative to one another), but that have a similar angle with respect to the reference plane 824. In another aspect of the disclosure, the heights of some support structures (e.g., 840) may be larger than other support structures. For example, in the sole 812, support structures around the periphery edge of the sole 812 that transition from the midfoot region to the heel region are taller than other support structures in the sole 812. Visually in FIGS. 8A-8C, these taller support structures have the appearance of being drawn upward or stretched relative to other support structures in the sole. Among other things, these taller peripheral regions of the sole 812 may contribute to lateral stability. In addition, these regions may provide an anchor surface for attaching the upper 814 to the sole 812 (e.g., in the biteline region using an adhesive or other bonding agent). Furthermore, by gradually increasing the support-structure height, as opposed to simply stacking additional support structures, the integrity of the matrix may be maintained in a manner that contributes to even distribution of force load.

Figure 10A:
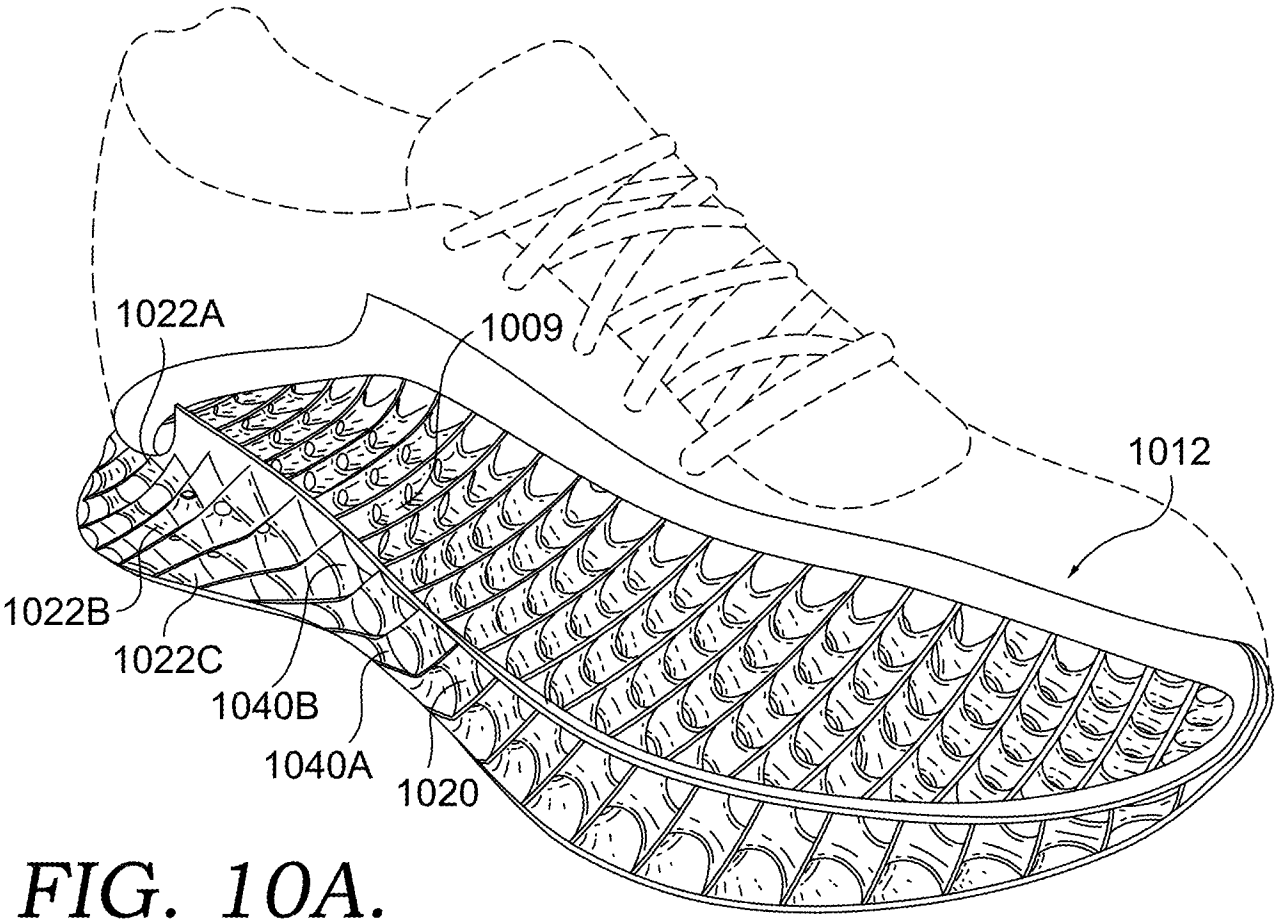
FIGS. 10A-10C depict a respective view of a sole in accordance with an aspect of this disclosure.
Figure 10B:
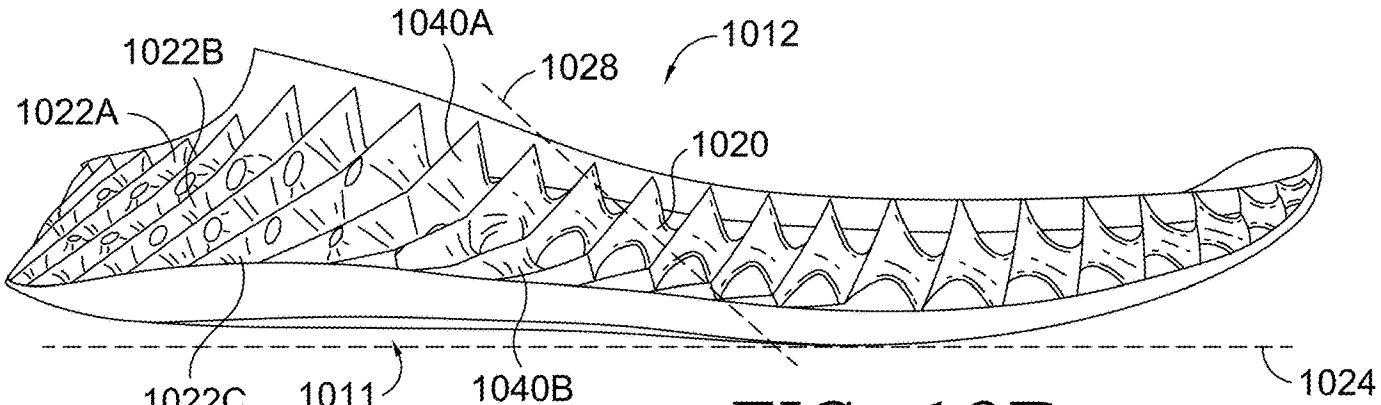
Figure 10C:
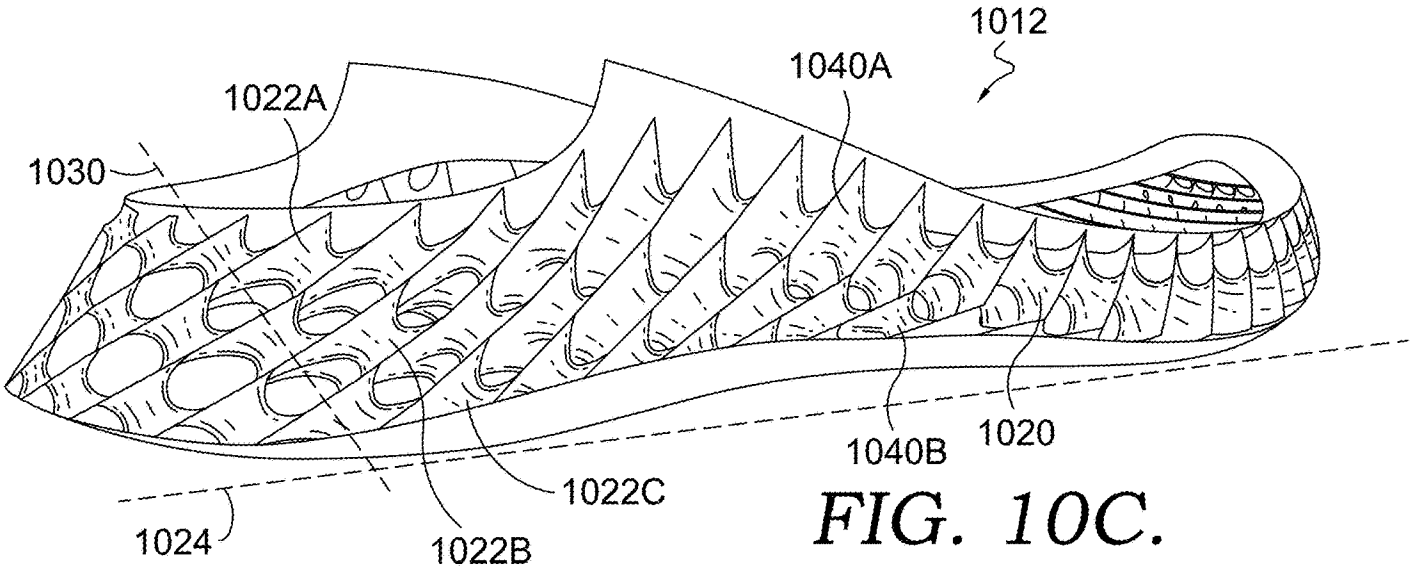
Figure 11A:
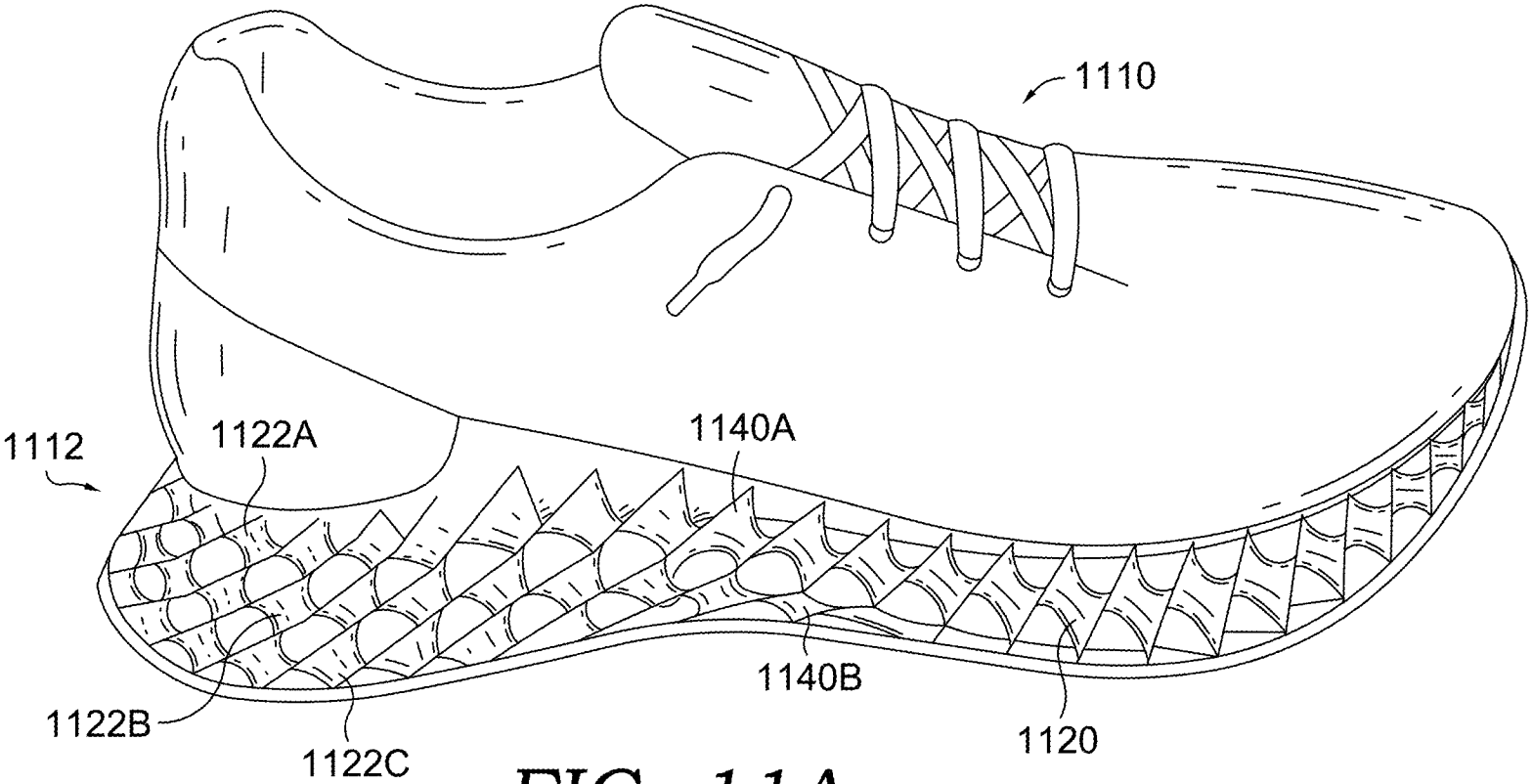
FIGS. 11A-11E depict a respective view of a footwear article having a sole structure with an aspect of this disclosure.
Figure 11B:
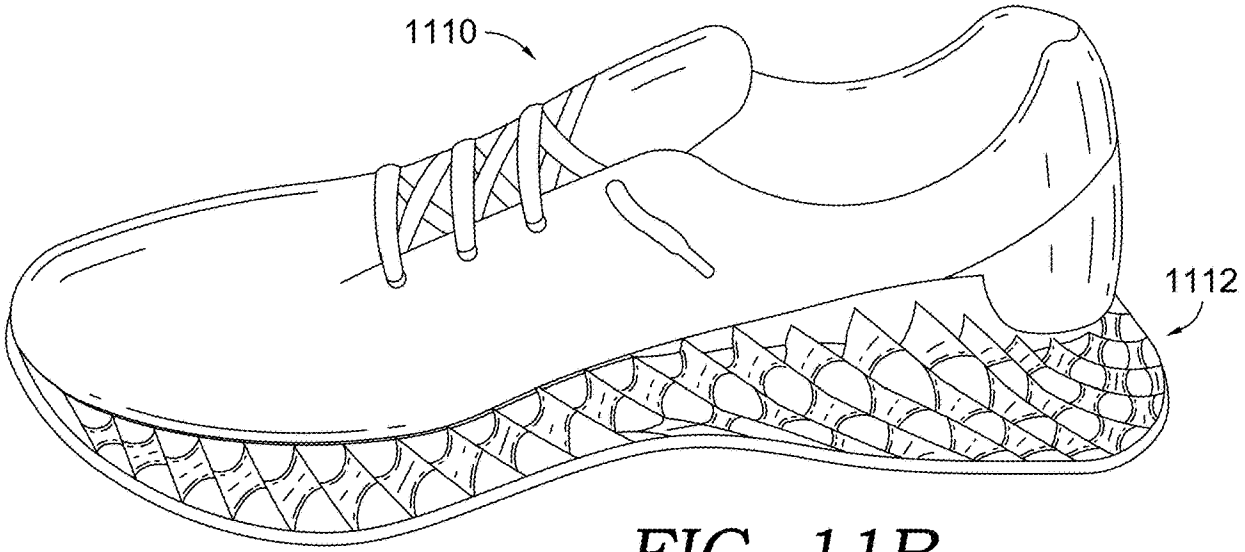
Figure 11C:
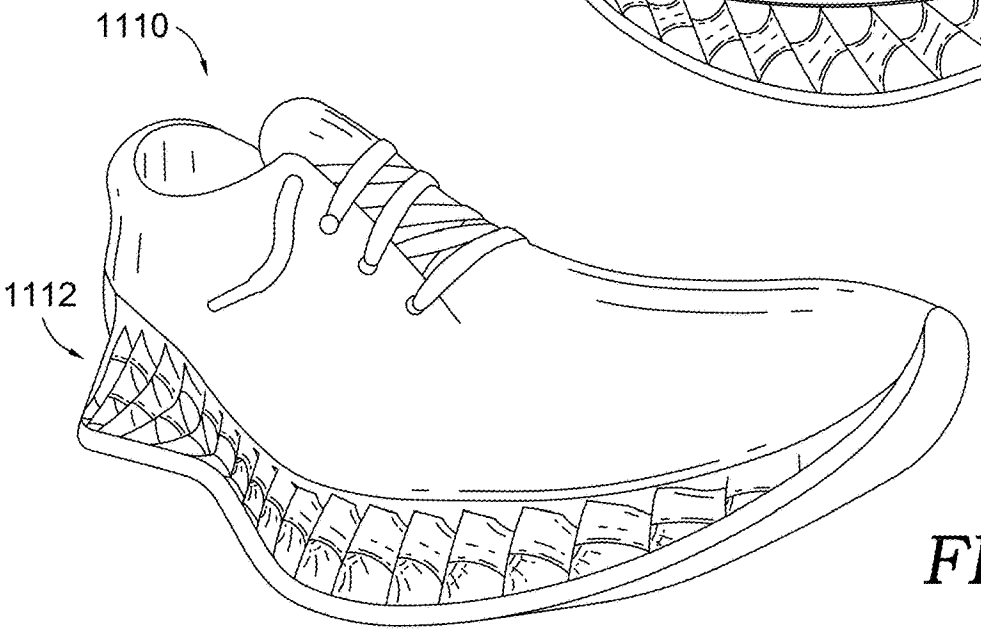
Figure 11E:
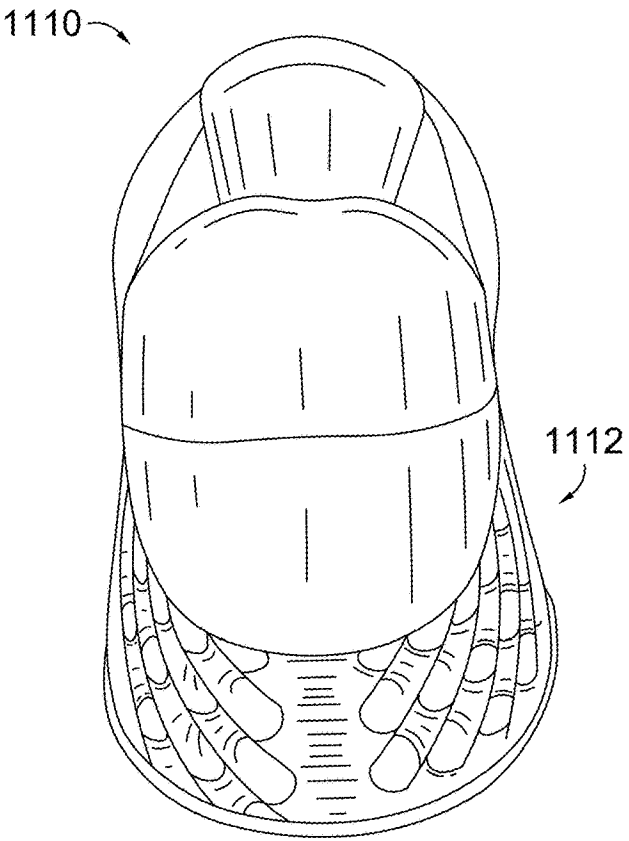
Figure 11D:
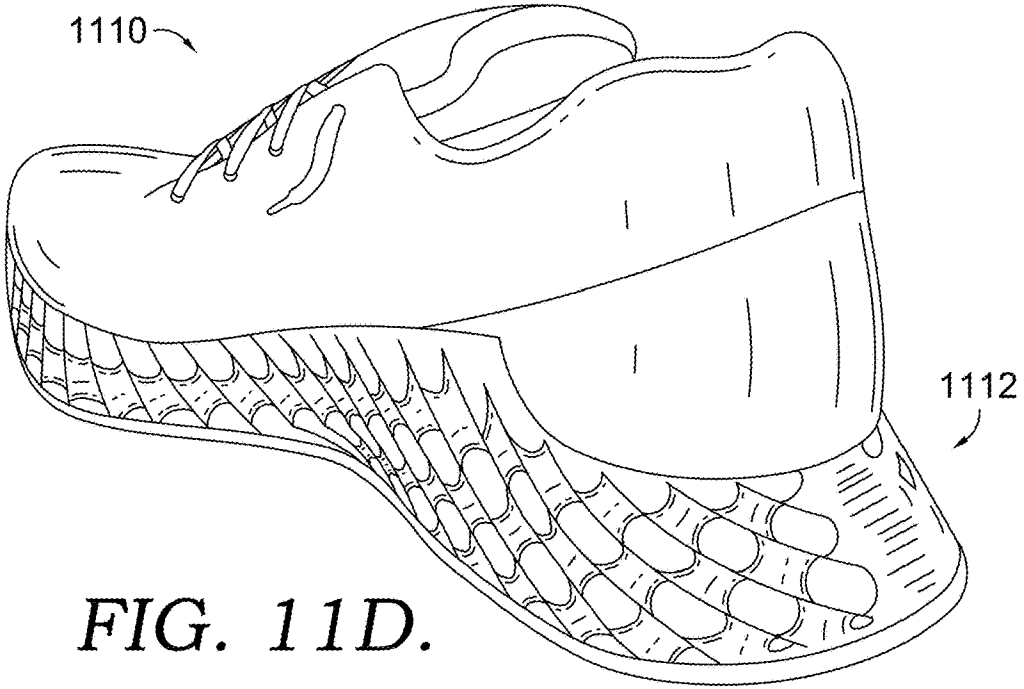

FIGS. 10A-10C include a sole 1012 having a system of support structures (e.g., 1020 and 1022A-C and 1040A-B), and at least some of the support structures include the features described with respect to the support structure 20 of FIG. 2. For example, the support structures constructing the sole 1012 include tubular bodies having inwardly curving walls. In another aspect, the exterior surfaces of the inwardly curving walls may be defined by a minimal-surface equation, such as E1. In a further aspect, a ground-contacting outsole of the sole 1012 includes two or more surfaces positioned in a reference plane 1024, and the support structures may include a reference axis 1028 and 1030 that is angled relative to the reference plane. The sole 1012 may include a system of support structures similar to the system 610 described with respect to FIG. 6. For example, continuous surfaces may transition from one support structure to adjacent support structures in a manner that might contribute even distribution force load and load attenuation. For the sake of brevity, all of the features of the support structures described with respect to FIGS. 1-6B are not reiterated here, but it is understood that the support structures and system of support structures of the sole 1012 may include all of those features.

The sole also includes a footbed surface 1009 and an outsole surface 1111. In an aspect of the disclosure, the system of support structures of the sole 1012 generally transitions from a first region (e.g., the heel region) to a second region (e.g., the midfoot region or the forefoot region). In the first region, the system of support structures are arranged into staggered rows of support structures (e.g., FIG. 6A), and some of the support structures in different rows are coaxial—in other words, the reference axis of a first support structure is aligned with the reference axis of a second support structure along a common axis. These coaxial support structures form columns of spaced apart, coaxial support structures (e.g., they are spaced apart by the staggered, interleaving rows of support structures), spanning the distance between the footbed surface 1009 and the outsole surface 1011. For example, in FIGS. 10A-10C, the heel region of the sole 1012 includes one or more columns of three support structures, such as the three support structures 1022A, 1022B, and 1022C (also referred to herein as a "three-stack arrangement). Having respective axes aligned along a common axis. In addition, the sole 1012 transitions from the columns of three support structures in the heel region of the sole 1012, to a single support structure (e.g., 1020) in the forefoot spanning the distance between the footbed surface 1009 and the outsole surface 1011. Support structures arranged in columns may also be referred to as "axially aligned," which describes two or more support structures that are aligned longitudinally (e.g., along the longitudinal orientation of the axis), sequentially (not concentrically) along a common axis, such that the axes of the axially aligned support structures are substantially coaxial. Although only support structures along the lateral side are identified in FIGS. 10A-10C, the three stack arrangement continues in adjacent rows as the system moves from the lateral side of the sole to the medial side of the sole. Similarly, a row of single support structures aligned with the support structure 1020 extends from the lateral side to the medial side.

As illustrated by FIGS. 10A-C, the system of support structures gradually transitions from the three-stack arrangement in the heel region (e.g., column of three support structures) to the single support structure in the forefoot. For example, the sole 1012 includes a two-stack arrangement with structures 1040A and 1040B in a midfoot region (e.g., structures 1040A and 1040B are aligned in a column) and between the three-stack arrangement and the single support structure 1020. As such, as the sole 1012 transitions from the heel region to the midfoot region to the forefoot region, the sole 1012 transitions from a three-stack arrangement to a two-stack arrangement to a single support structure.

Each of the three support structures 1022A-C in the heel region, the two support structures 1040A-B in the midfoot, and the single support structure 1020 in the forefoot includes respective dimensions, such as height, diameter, and wall thickness. The gradual transition from a three stack to a two stack to a single support structure may include a constant set of respective dimensions across all support structures. Or, in another embodiment, the respective dimensions may gradually change as the system of structures transitions from the three stack down to the single support structure, in order to tune the support structure to achieve a functionality or performance in a particular portion of the sole structure 1012. For example, in FIGS. 10A-10C, the height of the single support structure 1020 is larger than the individual heights of each of the support structures 1022A-C. In addition, the height of support structures positioned between the three-stack arrangement and the single support structure may be smaller than the single support structure 1020 and larger than the individual height of the support structures in the three stack. In another aspect, the wall thickness of the support structures may transition from a thicker wall in the heel region (e.g., 0.85 mm to 1.5 mm) to thinner walls in the forefoot region (e.g., 0.50 mm to 1.15 mm), or from thinner walls in the heel region (e.g., 0.50 mm to 1.15 mm) to thicker walls in the forefoot region (e.g., 0.85 mm to 1.5 mm).

For illustrative purposes, FIGS. 11A-E depict illustrations of a footwear article 1110 including a sole 1112, which is similar to the sole 1012. For example, the sole 1112 includes a system of support structures that transitions from a three-stack arrangement (e.g., 1122A, 1122B, and 1122C) in the heel region down to a single support structure 1120 in the forefoot. As indicated above, each of the support structures might include similar dimensions, such as height, diameter, and wall thickness. Or in an alternative embodiment, these dimensions might gradually change from one portion of the sole 1112 to another portion.

As described in other portions of this disclosure, the soles 1012 and 1112 provide cushioning and energy return and are lighter weight than some soles constructed in accordance with some traditional technologies (e.g., solid foam soles). Because the support structures (e.g., 1020, 1120, 1022, 1122, and 1140) contribute to the cushioning and functionality, less base material is used, as compared to systems that rely more on the material properties of the base foam material. In addition, the configuration of the support structures (e.g., minimal surface) allows for a force load (e.g., ground contact upon foot strike when running) to be more evenly spread throughout the system, providing a consistent cushion throughout the initial phase of the applied force load. Furthermore, the support structures of the soles 1012 and 1112 are more durable, and less susceptible to breakage, tearing, or rupture (as compared with other types of support structures, such as struts), since the force load is applied evenly throughout the walls of the support structures and load points are minimized.

Soles constructed in accordance with aspects of this disclosure have been shown to provide a load attenuation that is different from other soles, and as used herein, "load attenuation" refers to act of reducing a force. For example, referring to FIG. 9 a line graph is depicted showing test results that depict sole deflection on the horizontal axis relative to force on the vertical axis. The deflection range is divided into an initial compression zone 914, a transition zone 916, and a final compression zone 918.

In general, the data is collected and measured by using a load-application device to actively apply a force to a predetermined value. For example, in one aspect data might be collected by dropping a 7.8 kg mass onto a sample and measuring "peak G" and "energy loss" (%). The 7.8 kg mass might take the form of a 4 cm diameter flat tup or ram that impacts one or more zones of a footwear article at 1.0 m/s. Generally, a lower peak G value suggests a softer cushioning, and a higher value indicates firmer cushioning. A difference in peak G values between two samples (e.g., two different sole structures) greater than 0.5 G is often considered to be a meaningful difference (outside the variance of the machine.) Moreover, tests often suggest that a difference in peak G values greater than 1.0 G for a heel impact translates to a subjective assessment by a wearer of a "Just Noticeable Difference" (JND) between the footwear samples. Energy loss is a measure of responsiveness, and the lower the energy loss the more responsive the cushioning. A difference in energy loss greater than 10% often considered to be a meaningful difference between two samples.

Figure 9:
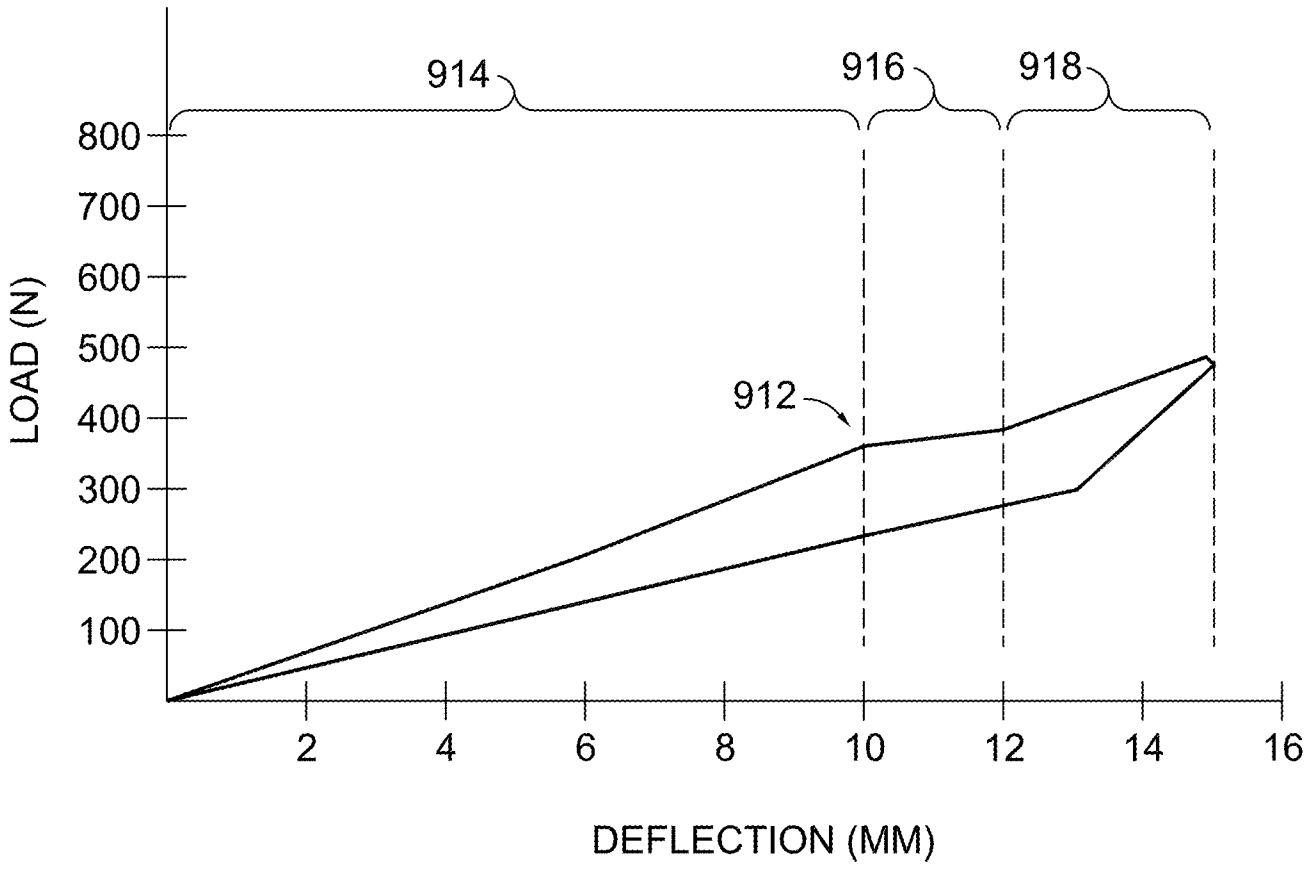
FIG. 9 depicts a graph of test results in accordance with an aspect of this disclosure.

The graph of FIG. 9 illustrates that about 175 N is applied in order to create about 5 mm of deflection, and about 350 N is applied in order to achieve about 10 mm of deflection. On average, up until about 10 mm of deflection, the sole deflects about 2 mm for every additional 70 N of force load, and this is describes the initial compression zone 914. However, once the sole reaches about 10 mm of deflection, less amount of force load is required to deflect the sole an additional 2 mm (i.e., from 10 mm to 12 mm), and according to the graph, this quantity is less than 50 N. This threshold amount of deflection reflects a tipping point 912, at which point the sole structure deflects more easily (with less force required), before the end of the force application, and this describes the transition zone 916. The deflection action of the sole finishes in the final compression zone 918 similarly to the initial compression zone 914. FIG. 9 could depict a single load-attenuation cycle or could represent average values for a single footwear sole structure that is subjected to cycle testing. In one aspect, cycle testing includes repeatedly dropping the tup or ram onto the subject midsole at a frequency correlated to a wearer's footstrike cadence when engaging in a particular activity, such as running.

A few interpretations could be applied to the graph of FIG. 9 to describe the features of the tested sole structure. For example, one feature illustrated by the graph of FIG. 9 is that the first two-thirds of sole deflection (i.e., from zero to 10 mm) occurs relatively linearly, suggesting a smooth and consistent compression under load. A second feature illustrated by the graph of FIG. 9 is that the tipping point, which may simulate or represent a "bottoming out," occurs near the end of the force cycle, and this later-phase tipping point helps to reduce the likelihood that more of the load would be transferred to the wearer's body. In other words, if too much deflection occurs earlier in the load cycle, then the sole has less ability to continue compressing as more force is applied, and this additional force would be transferred to the wearer. Another feature is illustrated by the final compression zone 918, which might suggest that the support-structure walls themselves continue to compress (e.g., compress from a thicker wall thickness to a thinner wall thickness), even after the support structures themselves might have folded or buckled, and this additional compression provides additional cushioning functionality.

In a further aspect, once the sole structure has reached the end of the final compression zone 918, the rebound resilience of the material of the sole structure contributes to the rate at which the sole structure transforms or "springs" back to the resting state, when no load is applied. For example, if a sole is constructed of a less resilient material with a lower bounce percentage, then the deflection might remain much higher after the final compression zone 918, until a much larger amount of the load had been removed.

Some aspects of this disclosure have been described with respect to the examples provided by FIGS. 1-11E. Additional aspects of the disclosure will now be described that may be related subject matter included in one or more claims or clauses of this application, or one or more related applications, but the claims or clauses are not limited to only the subject matter described in the below portions of this description. These additional aspects may include features illustrated by FIGS. 1-11E, features not illustrated by FIGS. 1-11E, and any combination thereof. When describing these additional aspects, reference may be made to elements depicted by FIGS. 1-11E for illustrative purposes.

As such, one aspect of the present disclosure includes a support structure for a footwear sole, and examples of a support structure include, but are not limited to, each of the items identified by reference numerals 20, 120, 220, 320, 620-632, 720, 722, 820, 822, and 840. A support structure might be included in a footwear sole or in a system of support structures, or might exist as a separate component, such as prior to be incorporated into a footwear sole. The support structure includes a tubular body including a wall that at least partially encloses a hollow cavity and that extends circumferentially around the hollow cavity. In addition, the tubular body comprising a first end and a second end that are spaced apart from one another in an axial direction. The wall curves inward as the wall extends between the first end and the second end. Furthermore, the wall includes an exterior surface facing away from the hollow cavity, the exterior surface being concave as it extends from the first end and the second end. The wall also includes an interior surface facing towards the hollow cavity, the interior surface being convex as it extends from the first end to the second end. As explained in other parts of this disclosure, the configuration of the support structure might contribute to a more even force distribution, as compared with a structure that has more joints, edges, or corners.

Another aspect of the present disclosure includes a support-structure arrangement for a footwear sole. It should be noted that the term "system" is also used in this disclosure to refer to a support-structure arrangement. The support-structure arrangement includes at least a first support structure and at least a second support structure. In other words, the arrangement might include two support structures and might include more than two support structures. For example, the support structures 120 and 220 might make up a support-structure arrangement. Likewise, the support structures 120 and 320 might make up a support-structure arrangement. In addition, the support structures 120, 220, and 320 might make up a support-structure arrangement. Furthermore, the system 410 or the system 610 might make up a support-structure arrangement. These are merely examples. In one aspect of a support-structure arrangement, each of the support structures includes a tubular body including a wall that at least partially encloses a hollow cavity and that extends circumferentially around the hollow cavity. In addition, the tubular body of each support structure includes a first end and a second end that are spaced apart in an axial direction, and the wall of each support structure curves inward as the wall extends between the first end and the second end. The wall includes an exterior surface facing away from the hollow cavity and an interior surface facing towards the hollow cavity. In one aspect, the first support structure and the second support structure are arranged end-to-end. For example, the support structure 120 is end-to-end, and axially offset from, the support structure 220. Moreover, a first portion of the exterior surface of the first support structure is continuous with a portion of the interior surface of the second support structure. As explained in other parts of this disclosure, the continuous, gradual, and smooth transition from one support structure to another might contribute to a more even force distribution within the system.

An additional aspect of the disclosure is directed to a footwear sole having a ground-contacting outsole coupled to an impact-attenuation midsole. The ground-contacting outsole has a ground-contacting surface that faces away from the impact-attenuation midsole and that is positioned in a reference plane. The footwear sole also includes a support structure having a tubular body including a wall that at least partially encloses a hollow cavity and that extends circumferentially around a reference axis. The reference axis intersects the reference plane at an angle in a range of about 30 degrees to about 60 degrees. The tubular body includes a first end and a second end that are spaced apart in an axial direction. In addition, the wall curves inward towards the reference axis as the wall extends between the first end and the second end.

Referring to FIG. 12, at least some examples of the present disclosure can include one or more of the support structures at least partially enclosed within an exoskeleton. For example, a footwear article 1210 can include a sole 1212, which can include various components, layers, parts, etc. In at least some examples, the sole 1212 can include a first force attenuation component 1214 and one or more second force attenuation components 1216, which can comprise one or more support structures or support systems. In examples, the support structures or support systems can be at least partially enclosed within an exoskeleton 1218 (which obscures the support structure(s) from view in FIG. 12). Furthermore, the support structures can be organized into a plurality of discrete support-system subunits 1220 and 1222, and each of the support-system subunits 1220 and 1222 can include a discrete set of support structures enclosed within a respective exoskeleton. In examples, the support structures at least partially enclosed within the exoskeleton can include tubular support structures (e.g., any of the tubular support structures identified by reference numerals 20, 120, 220, 320, 620-632, 720, 722, 820, 822, and 840). In some examples, the support structures or the system of support structures at least partially enclosed within the exoskeleton can include a three-dimensional (3D) lattice associated with a repeating pattern of interconnected nodes and frame members.

In examples, the first force attenuation component 1214 can include a forefoot portion, a midfoot portion, a heel portion, or any combination thereof. In addition, the first force attenuation component 1214 can be configured to operate together with, and couple with, the second force attenuation component 1216 to impart load attenuation (e.g., cushion and/or responsiveness) in one or more regions of the footwear article 1210. For example, the first force attenuation component 1214 can include one or more cavities or recesses configured to receive the subunits (e.g., 1220 and 1222) of the second portion. In addition, the first force attenuation component 1214 can include walls that extend downward (e.g., away from the foot-receiving cavity and towards the ground-contacting surface) and wrap at least partially around the subunits of the second portion, such as to mount to the subunits and constrain lateral and longitudinal movement of the subunits. In at least some examples, the first force attenuation component 1214 can comprise a foamed material (e.g., Ethylene-Vinyl Acetate (EVA), phylon, etc.). In at least some examples, the first force attenuation component 1214 can be manufactured to shape (e.g., shaped to mate with the second force attenuation component 1216), such as by injection molding, 3D additive-manufacturing technique, etc. to include a recess or cavity configured to nest with the second force attenuation component 1216. In some examples, the first force attenuation component 1214 can include a fluid-filled bladder (e.g., air filled bladder).

Figure 13A:
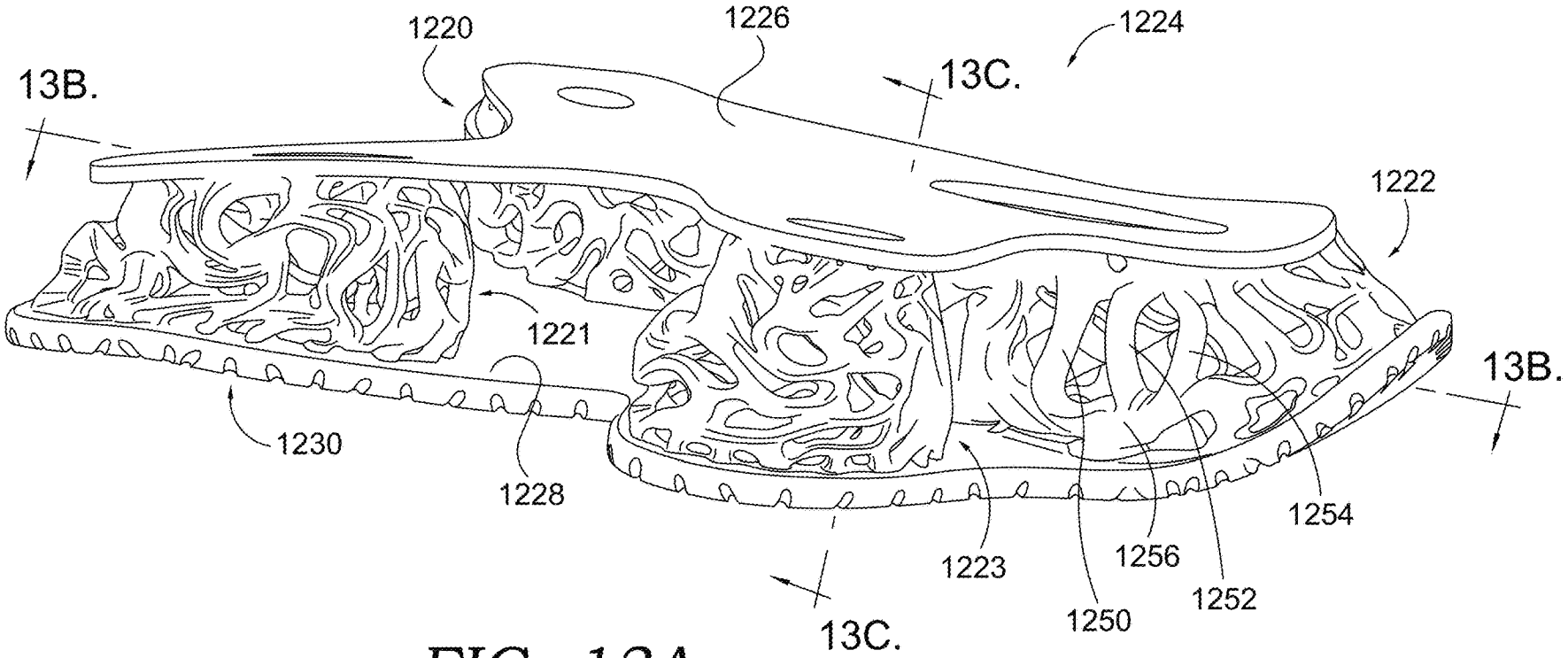
FIGS. 13A-13C depict various views of a cartridge of subunits, the subunits including support structures and an exoskeleton, in accordance with examples of this disclosure.
Figure 13B:
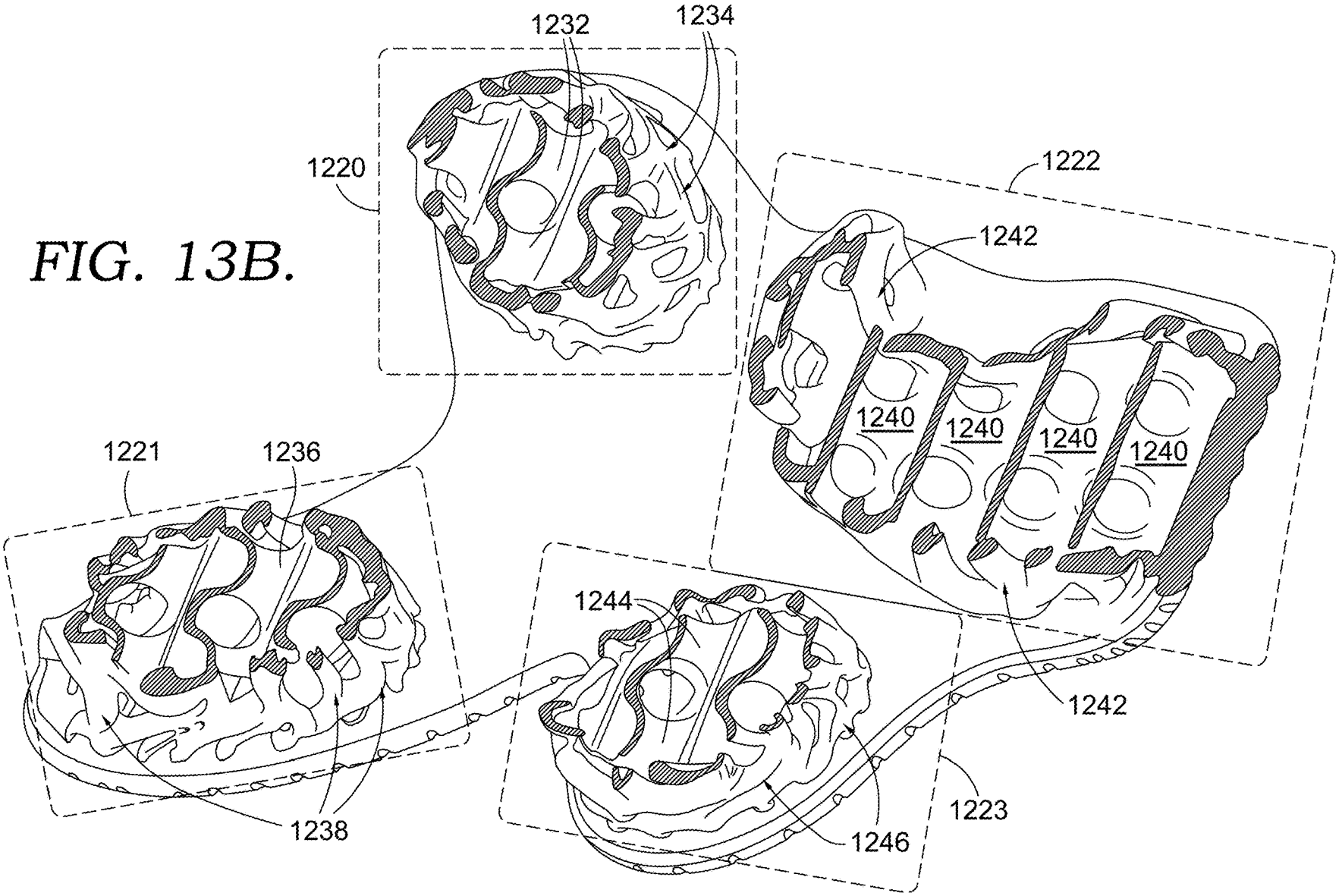
Figure 13C:
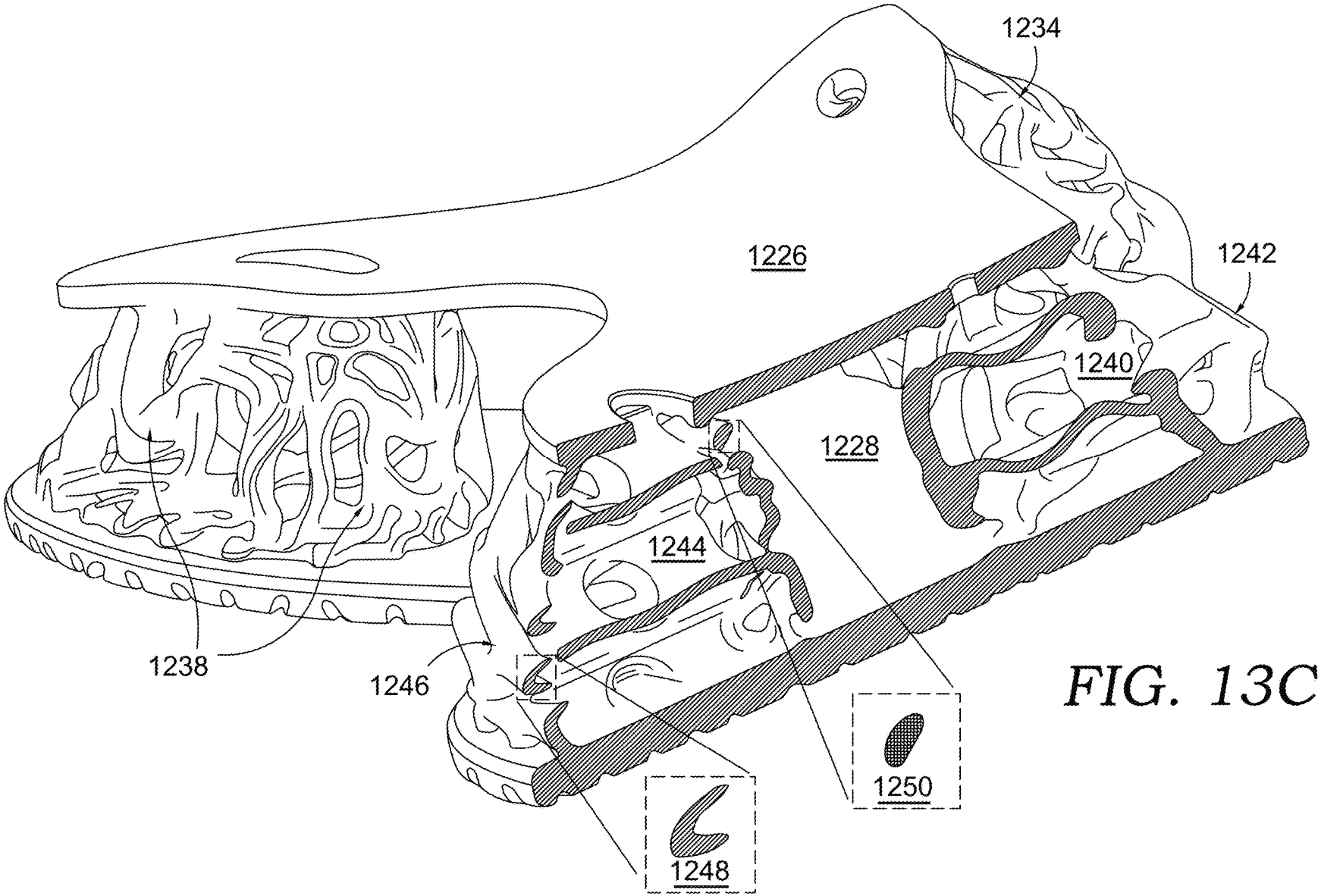

In at least some examples, the support-system subunits 1220 and 1222 comprise at least part of a subunits cartridge that is integratable into the sole 1212. That is, the subunits 1220 and 1222 can comprise parts of a cartridge that can be configured to fit with, operate in conjunction with, and connect with the first force attenuation component 1214 of the sole 1212 or with other parts of the sole 1212. FIG. 12 depicts the subunits 1220 and 1222 already integrated into the sole 1212. Referring to FIGS. 13A, 13B, and 13C, other views depict the subunits 1220 and 1222 in a subunits cartridge 1224 separately from the footwear article 1210 and the sole 1212. In addition, the cartridge 1224 can include additional subunits, such as the subunits 1221 and 1223. In other examples, a cartridge can include fewer subunits (e.g., one subunit, two subunits, or three subunits) or more subunits (e.g., more than four).

In some examples, the cartridge 1224 can include various components. For example, the cartridge 1224 can include a top plate 1226, a bottom plate 1228, and one or more discrete support-system subunits. In some examples, the top plate 1226 can be configured to interface with (e.g., connect to) other parts of the footwear article 1210, such as with other parts of the sole 1212. For example, the top plate 1226 can be shaped to nest into a recess of the first force attenuation component 1214 and/or can receive a bonding agent for attachment to the first force attenuation component 1214. The top plate 1226 can be configured to attach to and/or nest beneath any underfoot, or footbed, sole structure. In addition, the top plate 1226 can operate to more evenly distribute forces across the one or more subunits. In at least some examples, the bottom plate 1228 can operate as a foundation for the subunits and can include a ground-contacting surface 1230 (e.g., on inferior face), which can include one or more tread elements.

The cartridge 1224 can connect with other parts of a sole in various manners. In at least some examples, the cartridge 1224 can be bonded or adhered to the other parts of the sole. For example, the top plate 1226 can be bonded to the underneath side of another part of the sole or the footwear article. In some examples, the top plate 1226 (or other parts of the cartridge 1224) can include a texture or other surface finish that is configured to optimize bonding and stronger adhesion with the other parts of the footwear article. In some examples, the top plate 1226 (or other parts of the cartridge 1224) can include a plug with barbs (or other protuberances) configured to mate in a corresponding recess on another part of the footwear article (e.g., a recess in a foam portion of the footwear article). A plug is just one example, and in other instances, the cartridge can include one or more other types of mechanical fasteners. In at least some examples, the cartridge 1224 can include or be combined with traction elements. For example, tread or traction lugs can be formed in, or coupled to, the underneath side of the bottom plate 1228.

In at least some examples, a discrete support-system subunit that comprises at least a part of a cartridge can include one or more support structures (e.g., stacked tubular support structures, 3D lattice, etc.) that are at least partially enclosed by an exoskeleton. In FIGS. 12 and 13A, the exoskeleton associated with each subunit obscures the support structures from view, and FIGS. 13B and 13C include cross sections associated with FIG. 13A in which at least some support structures are viewable. For example, the subunit 1220 includes the support structure(s) 1232 and the exoskeleton 1234 (e.g., at least partially enclosing the support structure(s) 1232); the subunit 1221 includes the support structure(s) 1236 and the exoskeleton 1238 (e.g., at least partially enclosing the support structure(s) 1236); the subunit 1222 includes the support structure(s) 1240 and the exoskeleton 1242 (e.g., at least partially enclosing the support structure(s) 1240); and the subunit 1223 includes the support structures 1244 and the exoskeleton 1246 (e.g., at least partially enclosing the support structures 1244).

In at least some examples, a subunit can refer to a system of support structures (e.g., which are connected directly to one another by a continuous set of walls, surfaces, linkages, and/or faces comprising the support structures) and to the exoskeleton that encloses the system of support structures. For example, the subunit 1220 includes various support structures (e.g., 1232) that are connected directly to one another by the walls, surfaces, and faces of the support structures (e.g., there are no intervening structures that are not the support structures) and comprise a discrete system of support structures. Further, the subunit 1221 includes a different set of support structures (e.g., 1236) that are connected directly to each other (e.g., by the walls, surfaces, and faces of the support structures and without intervening structures that are not the support structures) and that are not connected directly to the support structures of the subunit 1220 (e.g., not connected by walls, surfaces, and faces of support structures). In examples, while the support structures of the subunits 1220 and 1221 can be indirectly connected to one another by the top plate 1226, the bottom plate 1228, and/or by exoskeleton(s), the indirect connection would not necessarily provide a sufficient connection to qualify the subunits as being the same subunit or the respective support structures as falling within the same subunit (e.g., they would still be discrete subunits despite the fact that there may be some indirect connection). In some examples, such as illustrated in FIG. 13B, one or more of the exoskeletons of the subunits 1220, 1221, 1222, and 1223 can be discontinuous with other exoskeletons, such that the exoskeleton does not share a frame member with another exoskeleton. In some examples, one or more of the exoskeletons of the subunits 1220, 1221, 1222, and 1223 can be continuous with other exoskeletons, such that the exoskeleton shares one or more frame members with another exoskeleton, and the respective support structures can still be not directly connected (e.g., even though there is a direct connection by way of the shared frame member between the exoskeletons).

In examples, the support structures 1232, 1236, 1240, and 1244 can include any and all combinations of properties (e.g., support structures height, width, wall thickness, angular orientation, wall contours, minimal surface, etc.) described with respect to the support structures (e.g., any of the support structure identified by reference numerals 20, 120, 220, 320, 620-632, 720, 722, 820, 822, and 840) described in other parts of this disclosure. For example, the support structures 1232, 1236, 1240, and 1244 can be tuned across the various zones of the footwear sole 1212 to achieve an amount of cushioning and responsiveness. The support structures can, in some examples, include a consistent wall thickness, height, and angular orientation across all parts of the sole. In some examples, each of these elements may be varied independently, collectively, and in any combination across different zones or regions of the footwear sole. In some examples, the support structures that comprise at least a portion of a subunit and that are enclosed by the exoskeleton can include a 3D-lattice.

In examples, the support structures associated with a given subunit (e.g., enclosed by a respective exoskeleton) can comprise a support system, such as the system 410, and can include any and all combinations of properties described with respect to the support systems described in other parts of this disclosure. In some examples, within a given subunit, properties of the respective support structures (e.g., that comprise the system of support structures) can include relatively consistent properties. In some examples, within a given subunit, properties of the respective support structures (e.g., that comprise the system of support structures) can vary among the subunit. In some examples, the properties of the support structures among one or more of the subunits 1220, 1221, 1222, and 1223 can be relatively consistent. In some examples, the properties of the support structures between two or more of the subunits can vary. As such, the properties can be tuned within a given subunit and/or across the subunits to achieve an amount of cushioning and responsiveness associated with the sole 1212.

In examples, an exoskeleton can include a lattice-like envelope of frame members (e.g., support struts, beams, ties, etc.) that form a network of interconnected nodes. For example, in FIG. 13A, the subunit 1222 is associated with an exoskeleton comprising the frame members 1250, 1252, and 1254, which merge into, and join at, a node 1256. The terms frame member and node are not necessarily meant to delineate precise divisions between parts of the exoskeleton, and in some instances, a frame member can gradually transition into a node, and vice versa.

In at least some examples of the present disclosure, an exoskeleton (e.g., the frame members and nodes associated with an exoskeleton) can at least partially enclose, contain, constrain, protect, etc. the support structures and the support-structure system(s) (e.g., a system of tubular support structures, a 3D lattice, etc.). For example, the exoskeleton can reduce the likelihood that debris might get captured among the support structures. In addition, the exoskeleton can permit the support structures to operate by compressing or collapsing, while still constraining support structure movement (e.g., under load), which can increase stiffness associated with the support system. In at least some examples, the exoskeleton can operate to enhance responsiveness, such as by providing, or contributing to, a restoring force, which can help the system return to a pre-compressed state, such as after a force has been removed.

In some examples, the frame members of the exoskeleton can operate in various manners, which can depend on a load or force exerted upon the exoskeleton (e.g., when a wearer is walking, running, jumping, etc.). For instance, the frame members can operate as a mechanical strut, tie, beam, and the like, depending on a direction from which a force or load is applied. In examples, the frame members of the exoskeleton are distinguishable from the support structures enclosed by the exoskeleton. For example, where the support structures include tubular support structures that at least partially circumscribe a hollow volume, the frame members of the exoskeleton are solid elongated members (e.g., bars). In addition, where the support structures include a 3D lattice with a repeating pattern of interconnected nodes and frame members, the exoskeleton is a single layer of frame members forming a wall around the support structures.

In examples of the present disclosure, the frame members of the exoskeleton include properties (e.g., length, cross-sectional shape and dimensionality, degree of rectilinearity or curvilinearity, orientation, etc.) that vary among the exoskeleton, and in this sense, the exoskeleton can be described as irregular, varied, free-form, or asymmetric. For example, referring to FIGS. 12 and 13A-13C, some frame members are relatively straight, whereas other include one or more curved segment. In some examples one frame member can be longer whereas a different frame member can be shorter. In some example, frame members can be more vertically aligned (e.g., more perpendicular with respect to a plane associated with a superior face of the bottom plate 1228). In some examples, frame members can be more horizontally aligned (e.g., more parallel with respect to the plane associated with the superior face of the bottom plate).

In addition, the cross-sectional properties associated with the frame members can vary from one frame member to another and/or within a same frame member (e.g., from one segment or portion of a frame member to another segment or portion of the same frame member. For example, in FIG. 13C, a first enlarged view 1248 is provided, illustrating a first cross section associated with the frame member 1246, and a second enlarged view 1250 is provided, illustrating a second cross section associated with a different frame member. In examples, the cross section can include various cross-section properties, such as a cross-sectional shape (e.g., a 2D shape or profile of the frame member at the cross section), a cross section perimeter, and a cross-sectional area, and in examples of this disclosure frame members can include different cross-section properties. In at least some examples, the properties associated with an exoskeleton can be tuned to impart or achieve an amount of cushion and/or responsiveness in a given region of the footwear article. For example, in areas in which it is desired to impart more protection to the support structures and/or to provide more force attenuation, the cross section can include a larger area or can include a shape more resistant to deformation.

Referring to FIG. 14, in some examples, a footwear article 1410 can include an exoskeleton 1412 that is more regular (e.g., as compared to FIG. 12 and FIGS. 13A-13C), such as with a repeating pattern of n-polygonal shapes (e.g., triangle, rectangle, diamond, pentagon, hexagon, etc.). In some examples, besides the properties of the exoskeleton 1412 being different from the exoskeleton described in FIG. 12 and FIGS. 13A-13C, other elements can be similar, such as the cartridge, support structures, subunits, etc.

Figure 15A:
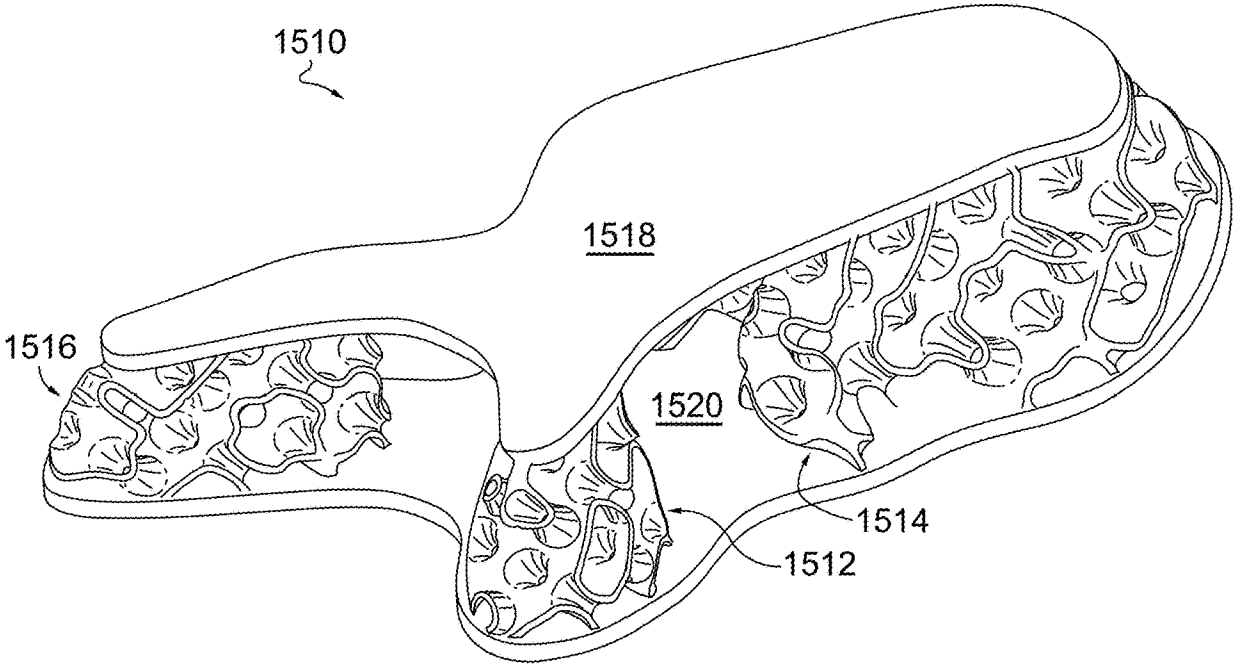
FIGS. 15A-15E depict various views of another cartridge of subunits that can comprise a portion of a sole, in accordance with examples of this disclosure.
Figure 15B:
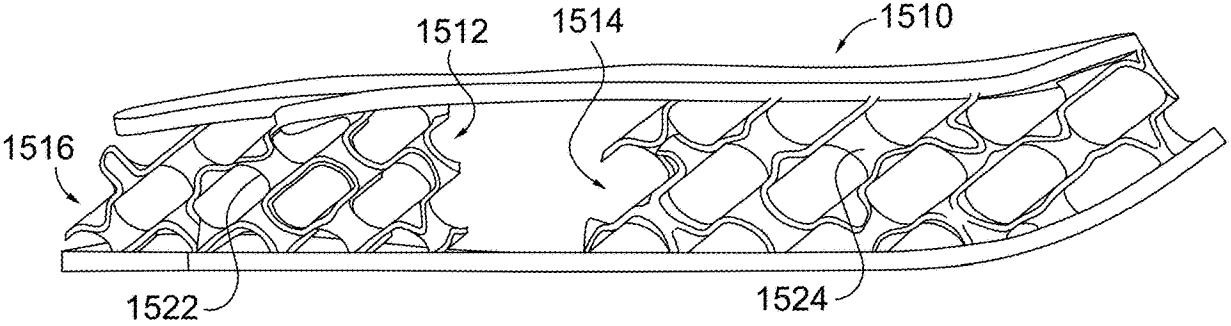
Figure 15C:
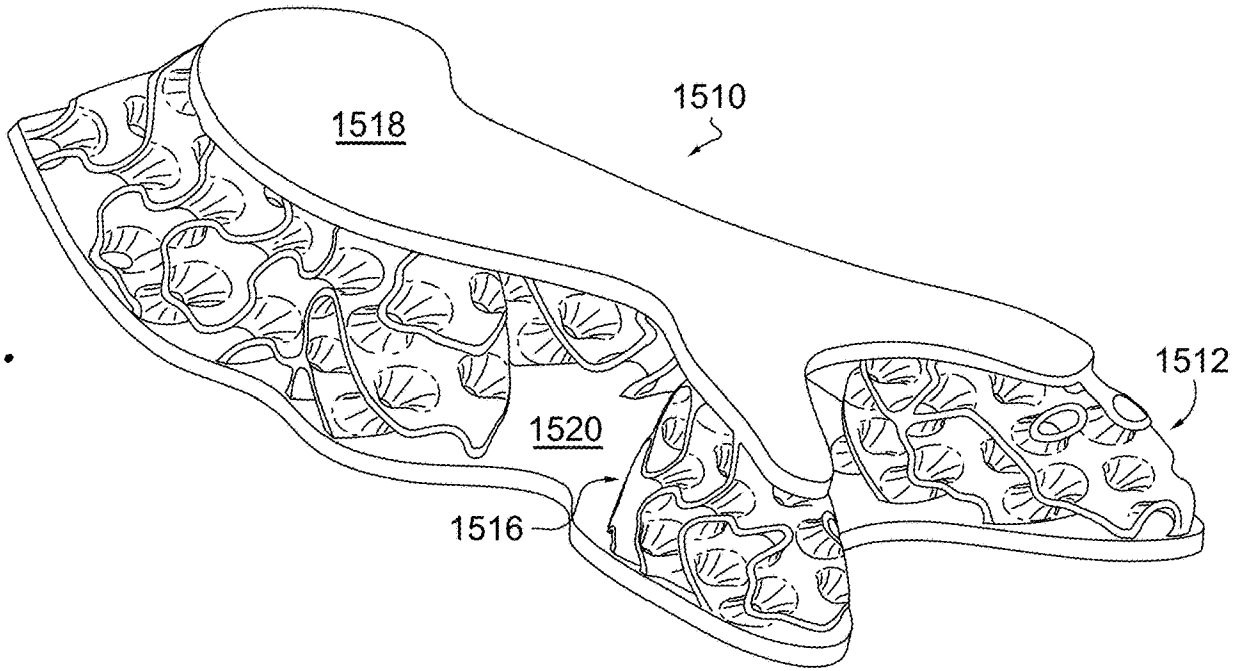
Figure 15D:
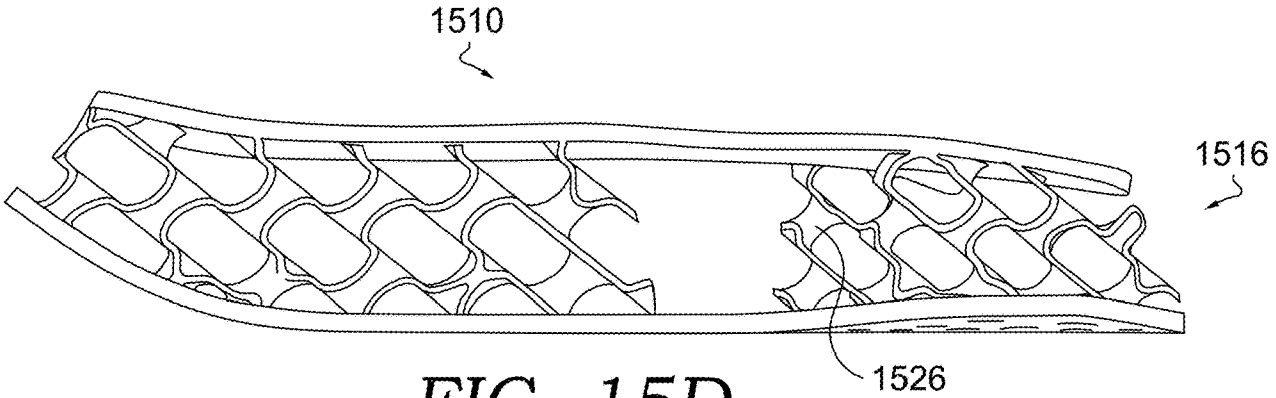

Referring to FIGS. 15A-15E, at least some examples of the present disclosure can include a sole component 1510 that includes one or more discrete support-system subunits without an exoskeleton enclosing the support structures. For example, FIG. 15A depicts a perspective view of the sole component 1510 from a first side; FIG. 15B depicts an elevation view from the first side; FIG. 15C depicts a perspective view from a second side; and FIG. 15D depicts an elevation view from the second side. In examples, a plurality of support structures can be organized into a plurality of discrete support-system subunits 1512, 1514, and 1516, and each of the support-system subunits 1512, 1514, and 1516 can include a discrete set of support structures attached directly to one another. In examples, the support structures that comprise the subunits 1512, 1514, and 1516 can include any and all combinations of properties (e.g., support structures height, width, wall thickness, angular orientation, wall contours, minimal surface, etc.) described with respect to the support structures (e.g., any of the support structure identified by reference numerals 20, 120, 220, 320, 620-632, 720, 722, 820, 822, and 840) described in other parts of this disclosure.

A footwear article and/or a sole structure for a footwear article can include more subunits than depicted in FIGS. 15A-15E or fewer subunits than depicted in FIGS. 15A-15E. The subunits can be positioned in a variety of different locations within the sole. For example, one or more subunits can be positioned at a location configured to cushion against larger forces than other locations within the sole (e.g., a location configured to cushion against forces associated with a foot strike when pushing off the ground during ambulation). The subunits can be positioned, in the heel region, in the midfoot region, in the forefoot region, along the medial side, along the lateral side, or any and all combinations thereof.

In examples, the sole component 1510 can be coupled to and integrated with another sole component, such as the first force attenuation component 1214 (e.g., foam element, fluid-filled air bladder, etc.). As such, although not explicitly depicted in FIGS. 15A-15E, some examples of this disclosure can include a sole and/or a footwear article in which the sole component 1510 (or any sole component with one or more discrete support-system subunits) is integrated into a sole (e.g., a foam midsole). As such, the other sole components (e.g., the foam sole) can include one or more cavities or recesses configured to receive and/or connect to the footwear component. In addition, the other sole components can include any of the other elements described with respect to the component 1214 or described with respect to other sole components.

In at least some examples, the sole component 1510 can be referred to as a cartridge that can be configured to fit with, operate in conjunction with, and connect with other parts of a sole. For example, the cartridge 1510 can include a top plate 1518 and a bottom plate 1520. In some examples, the top plate 1518 can be configured to interface with (e.g., connect to) other parts of a footwear article, such as with other parts of the sole. For example, the top plate 1518 can be shaped to nest into a recess of another part of the sole (e.g., the midsole) and/or can receive a bonding agent for attachment to the sole. In addition, the top plate 1518 can operate to more evenly distribute forces across the one or more subunits 1512, 1514, and 1516. In at least some examples, the bottom plate 1520 can operate as a foundation for the subunits and can include a ground-contacting surface, which can include one or more tread elements.

The cartridge 1510 can connect with other parts of a sole in various manners. In at least some examples, the cartridge 1510 can be bonded or adhered to the other parts of the sole. For example, the top plate 1518 can be bonded to the underneath side of another part of the sole or the footwear article.

In some examples, the top plate 1518 (or other parts of the cartridge 1510) can include a texture or other surface finish that is configured to optimize bonding and stronger adhesion with the other parts of the footwear article.

In some examples, the top plate 1518 (or other parts of the cartridge 1510) can include a plug with barbs (or other protuberances) configured to mate in a corresponding recess on another part of the footwear article (e.g., a recess in a foam portion of the footwear article). A plug is just one example, and in other instances, the cartridge can include one or more other types of mechanical fasteners.

Figure 15E:
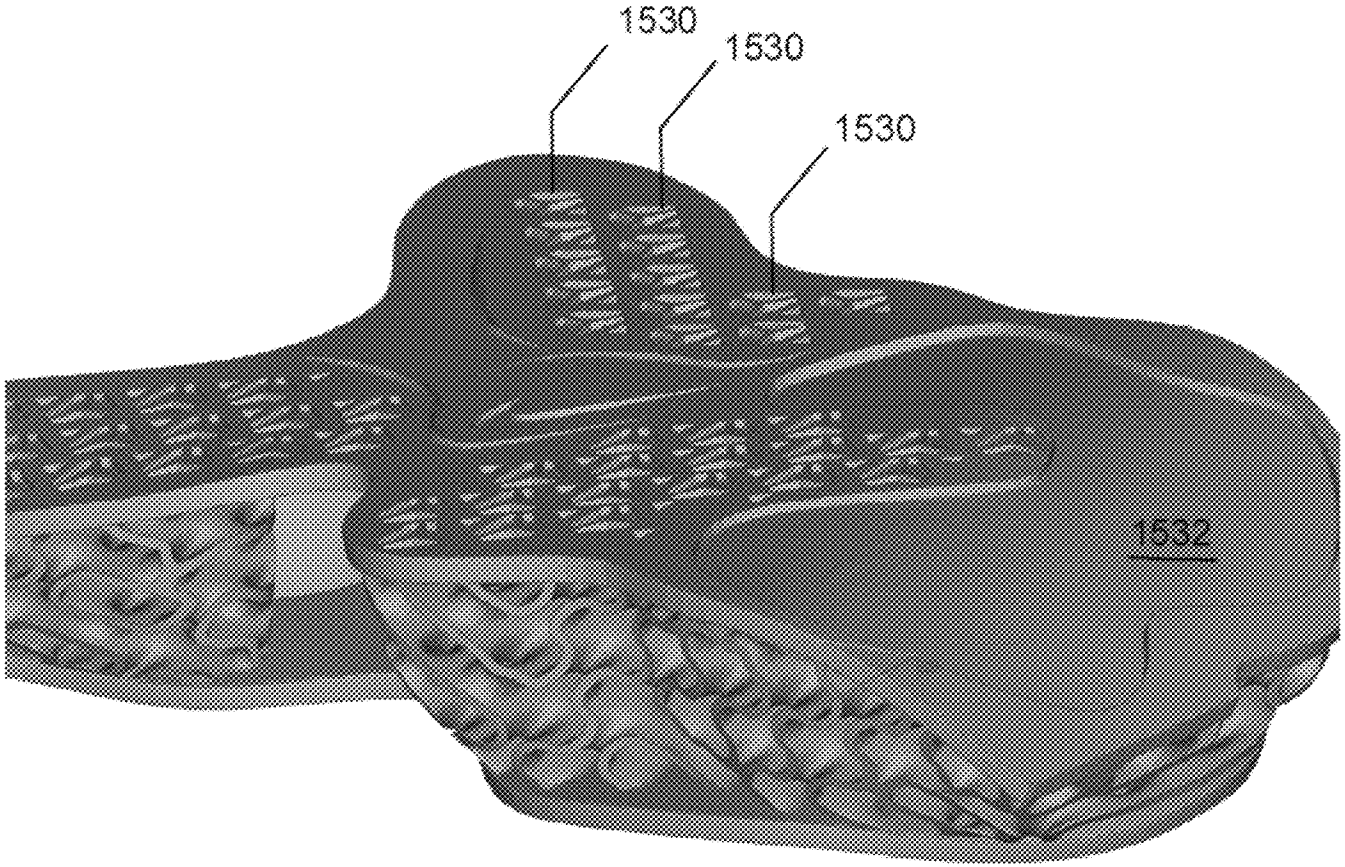

In at least some examples, the cartridge 1510 can include or be combined with traction elements. For example, tread or traction lugs can be formed in, or coupled to, the underneath side of the bottom plate 1520. Referring to FIG. 15E, an example of a bottom face of the cartridge is depicted, including an arrangement of recessed traction elements 1530. FIG. 15E is one example, and in other instance, the traction elements can include other patterns, geometries, and shapes. In some examples, the bottom face can also include protruding traction elements. In some examples, a rubber pad (or pad from another material) can be affixed to the bottom face, such as in areas 1532 susceptible to more wear and/or force.

In at least some examples, a discrete support-system subunit that comprises at least a part of a cartridge can include one or more support structures (e.g., stacked tubular support structures, 3D lattice, etc.). For example, the subunit 1512 includes the support structure(s) 1522; the subunit 1514 includes the support structure(s) 1524; and the subunit 1516 includes the support structure(s) 1526. In at least some examples, a subunit (e.g., 1512, 1514, and 1516) can refer to a system of support structures that are connected directly to one another by a continuous set of walls, surfaces, linkages, and/or faces comprising the support structures. For example, the subunit 1512 includes various support structures (e.g., 1522) that are connected directly to one another by the walls, surfaces, and faces of the support structures (e.g., there are no intervening structures that are not the support structures) and comprise a discrete system of support structures. Further, the subunit 1514 includes a different set of support structures (e.g., 1524) that are connected directly to each other (e.g., by the walls, surfaces, and faces of the support structures and without intervening structures that are not the support structures) and that are not connected directly to the support structures of the subunit 1512 (e.g., not connected by walls, surfaces, and faces of support structures). In examples, while the support structures of the subunits 1512 and 1514 can be indirectly connected to one another by the top plate 1518 and/or by the bottom plate 1520 the indirect connection would not necessarily provide a sufficient connection to qualify the subunits as being the same subunit or the respective support structures as falling within the same subunit (e.g., they would still be discrete subunits despite the fact that there may be some indirect connection).

In examples, the support structures 1522, 1524, and 1526 (e.g., as well as any other support structures in the subunits 1512, 1514, and/or 1516) can include any and all combinations of properties (e.g., support structures height, width, wall thickness, angular orientation, wall contours, minimal surface, etc.) described with respect to the support structures (e.g., any of the support structure identified by reference numerals 20, 120, 220, 320, 620-632, 720, 722, 820, 822, and 840) described in other parts of this disclosure. For example, the support structures 1522, 1524, and 1526 can be tuned across the various zones of the cartridge 1510 to achieve an amount of cushioning and responsiveness. The support structures can, in some examples, include a consistent wall thickness, height, and angular orientation across all parts of the sole. In some examples, each of these elements may be varied independently, collectively, and in any combination across different zones or regions of the footwear sole.

In examples, the support structures associated with a given subunit (e.g., 1512, 1514, and/or 1516) can comprise a support system, such as the system 410, and can include any and all combinations of properties described with respect to the support systems described in other parts of this disclosure. In some examples, within a given subunit, properties of the respective support structures (e.g., that comprise the system of support structures) can include relatively consistent properties. In some examples, within a given subunit, properties of the respective support structures (e.g., that comprise the system of support structures) can vary among the subunit. In some examples, the properties of the support structures among one or more of the subunits 1512, 1514, and/or 1516 can be relatively consistent. In some examples, the properties of the support structures between two or more of the subunits can vary. As such, the properties can be tuned within a given subunit and/or across the subunits to achieve an amount of cushioning and responsiveness associated with the sole component 1510.

Subject matter set forth in this disclosure, and covered by at least some of the claims, may take various forms, such as a cushioning structure for a midsole, a cushioning system for a midsole, a midsole for a footwear article, a footwear article, any combination thereof, and one or more methods of making each of these aspects or making any combination thereof. Other aspects include a method of tuning a cushioning structure for a midsole, as well as a method of tuning a cushioning system for a midsole.

EXAMPLE CLAUSES

1. A footwear article comprising: an upper; a sole coupled to the upper; the sole comprising: a force attenuation component comprising a cartridge: the cartridge comprising: a top plate; a bottom plate; a system of support structures that is between the top plate and the bottom plate and that attenuates forces operating on at least one of the top plate or the bottom plate; and an exoskeleton that at least partially encloses the system of support structures and that comprises interconnected frame members.

2. The footwear article of clause 1, wherein the system of support structures comprises a first tubular support structure stacked atop a second tubular support structure.
3. The footwear article of clause 1, wherein a support structure of the system of support structures comprises a tubular support structure that is oriented at an angle with respect to the bottom plate, the angle being in a range of about 30 degrees to about 60 degrees.
4. The footwear article of clause 1, wherein the system of support structures comprises a three dimensional (3D) lattice.
5. The footwear article of any one or more of clauses 1 through 4, wherein: the system of support structures and the exoskeleton comprise a first discrete subunit; the sole comprises a second discrete subunit comprising a second system of support structures that is between the top plate and the bottom plate and that operates to attenuate forces operating on at least one of the top plate or the bottom plate; and a second exoskeleton that at least partially encloses the second system of support structures and that comprises a second lattice-type network of frame members.
6. The footwear article of clause 5, wherein the first discrete subunit comprises one or more properties that are different from the second discrete subunit.
7. The footwear article of clause 6, wherein the first discrete subunit imparts a first amount of impact attenuation and the second discrete subunit imparts a second amount of impact attenuation, which is different from the first amount of impact attenuation.
8. The footwear article of clause 6 or clause 7, wherein the first discrete subunit is in a first region of the sole and the second discrete subunit is in a second region of the sole, which is different from the first region.
9. The footwear article of any one or more of clause 1 through clause 8, wherein the interconnected frame members comprises a first frame member having a first property and a second frame member having a second property, which is different from the first property.
10. The footwear article of clause 9, wherein the first property and the second property comprise a respective cross-sectional shape.
11. The footwear article of clause 9 or clause 10, wherein the first property and the second property comprise a respective frame-member length between nodes.
12. The footwear article of any one or more of clause 9 through clause 11, wherein the first property and the second property comprise a respective frame-member cross-sectional width or a respective frame-member cross-sectional area.
13. The footwear article of any one or more of clause 1 through clause 12, wherein the exoskeleton comprises a repeating pattern of n-polygonal shapes.
14. The footwear article of clause 1, wherein the sole comprises a recess, and wherein the cartridge is nested in the recess.
15. The footwear article of any one or more of clause 1 through clause 13, wherein the recess comprises a portion of a second force attenuation component.
16. The footwear article of clause 15, wherein the second force attenuation component comprises a foam midsole element.
17. The footwear article of clause 15, wherein the second force attenuation component comprises a fluid-filled bladder.
18. A footwear article comprising: an upper; a sole coupled to the upper; the sole comprising: a force attenuation component comprising a cartridge: the cartridge comprising: a top plate; a bottom plate; a first system of support structures that comprises a first discrete subunit, and a second system of support structures that comprises a second discrete subunit, wherein the first discrete subunit and the second discrete subunit are positioned between the top plate and the bottom plate and attenuates forces operating on at least one of the top plate or the bottom plate.
19. The footwear article of clause 18, wherein the first discrete subunit comprises one or more properties that are different from the second discrete subunit.
20. The footwear article of clause 19, wherein the first discrete subunit imparts a first amount of impact attenuation and the second discrete subunit imparts a second amount of impact attenuation, which is different from the first amount of impact attenuation.
21. The footwear article of clause 19 or clause 20, wherein the first discrete subunit is in a first region of the sole and the second discrete subunit is in a second region of the sole, which is different from the first region.
22. The footwear article of any one or more of clause 18 through clause 21, wherein the first system of support structures comprises a first tubular support structure stacked atop a second tubular support structure.
23. The footwear article of any one or more of clause 18 through clause 22, wherein a support structure of the first system of support structures comprises a tubular support structure that is oriented at an angle with respect to the bottom plate, the angle being in a range of about 30 degrees to about 60 degrees.
24. The footwear article of any one or more of clause 18 through clause 23, wherein the first system of support structures comprises a three dimensional (3D) lattice.
25. The footwear article of any one or more of clause 18 through clause 24, wherein the sole comprises a recess, and wherein the cartridge is nested in the recess.
26. The footwear article of clause 25, wherein the recess comprises a portion of a second force attenuation component.
27. The footwear article of clause 26, wherein the second force attenuation component comprises a foam midsole element.
28. The footwear article of clause 26, wherein the second force attenuation component comprises a fluid-filled bladder.
29. A footwear article comprising: an upper; a sole coupled to the upper; the sole comprising: a first force attenuation component comprising a recess; a second force attenuation component comprising a cartridge nested in the recess and comprising: a top plate; a bottom plate; and a system of support structures that is between the top plate and the bottom plate and attenuates forces operating on at least one of the top plate or the bottom plate.

30. The footwear article of clause 29, wherein the first force attenuation component comprises a foam midsole element.
31. The footwear article of clause 29, wherein the first force attenuation component comprises a fluid-filled bladder.
32. The footwear article of any one or more of clause 29 through clause 31, wherein the system of support structures comprises a first tubular support structure stacked atop a second tubular support structure.
33. The footwear article of any one or more of clause 29 through clause 32, wherein a support structure of the system of support structures comprises a tubular support structure that is oriented at an angle with respect to the bottom plate, the angle being in a range of about 30 degrees to about 60 degrees.
34. The footwear article of any one or more of clause 29 through clause 33, wherein the system of support structures comprises a three dimensional (3D) lattice.
35. The footwear article of any one or more of clause 29 through clause 34, wherein an exoskeleton at least partially encloses the system of support structures.
36. The footwear article of clause 35, wherein the exoskeleton comprises interconnected frame members.
37. The footwear article of clause 36, wherein the interconnected frame members comprises a first frame member having a first property and a second frame member having a second property, which is different from the first property.
38. The footwear article of clause 37, wherein the first property and the second property comprise a respective cross-sectional shape.
39. The footwear article of clause 37 or clause 38, wherein the first property and the second property comprise a respective frame-member length between nodes.
40. The footwear article of any one or more of clause 37 through 39, wherein the first property and the second property comprise a respective frame-member cross-sectional width or a respective frame-member cross-sectional area.
41. The footwear article of any one or more of clause 35 through clause 40, wherein the exoskeleton comprises a repeating pattern of n-polygonal shapes.
42. The footwear article of any one or more of clause 29 through clause 41, wherein: the system of support structures comprises a first discrete subunit; and the sole comprises a second discrete subunit comprising a second system of support structures that is between the top plate and the bottom plate and that attenuates forces operating on at least one of the top plate or the bottom plate.
43. The footwear article of clause 42, wherein the first discrete subunit comprises one or more properties that are different from the second discrete subunit.
44. The footwear article of clause 43, wherein the first discrete subunit imparts a first amount of impact attenuation and the second discrete subunit imparts a second amount of impact attenuation, which is different from the first amount of impact attenuation.
45. The footwear article of clause 42 or clause 43, wherein the first discrete subunit is in a first region of the sole and the second discrete subunit is in a second region of the sole, which is different from the first region.
46. A method comprising: forming, by molding a foamed material, a first load attenuation component; forming, by a 3D additive manufacturing technique, a cartridge comprising a second force attenuation component; coupling the cartridge to the first load attenuation component; and forming, with the first load attenuation component and the cartridge, a sole for a footwear article.
47. The method of clause 46, wherein the cartridge comprises: a top plate; a bottom plate; and a system of support structures that is between the top plate and the bottom plate and that operates to attenuate forces operating on at least one of the top plate or the bottom plate.
48. The method of clause 46, wherein the cartridge comprises an exoskeleton that at least partially encloses the system of support structures and that comprises interconnected frame members.
49. The method of clause 46, wherein the cartridge comprises a material that is different from the foamed material.
50. A cartridge for a footwear article, the cartridge comprising: a top plate, a bottom plate, and a system of support structures between the top plate and the bottom plate.
51. The cartridge of clause 50, wherein the system of support structures comprises a first tubular support structure stacked atop a second tubular support structure.
52. The cartridge of any one or more of clause 50 or clause 51, wherein a support structure of the system of support structures comprises a tubular support structure that is oriented at an angle with respect to the bottom plate, the angle being in a range of about 30 degrees to about 60 degrees.
53. The cartridge of any one or more of clause 50 through clause 52, wherein the system of support structures comprises a three dimensional (3D) lattice.
54. The cartridge of any one or more of clause 50 through clause 53, wherein an exoskeleton at least partially encloses the system of support structures.
55. The cartridge of clause 54, wherein the exoskeleton comprises interconnected frame members.
56. The cartridge of clause 55, wherein the interconnected frame members comprises a first frame member having a first property and a second frame member having a second property, which is different from the first property.
57. The cartridge of clause 56, wherein the first property and the second property comprise a respective cross-sectional shape.
58. The cartridge of clause 56 or clause 57, wherein the first property and the second property comprise a respective frame-member length between nodes.
59. The cartridge of any one or more of clause 56 through 58, wherein the first property and the second property comprise a respective frame-member cross-sectional width or a respective frame-member cross-sectional area.
60. The cartridge of any one or more of clause 54 through clause 59, wherein the exoskeleton comprises a repeating pattern of n-polygonal shapes.
61. The cartridge of any one or more of clause 50 through clause 60, wherein: the system of support structures comprises a first discrete subunit; and the sole comprises a second discrete subunit comprising a second system of support structures that is between the top plate and the bottom plate and that attenuates forces operating on at least one of the top plate or the bottom plate.

62. The cartridge of clause 61, wherein the first discrete subunit comprises one or more properties that are different from the second discrete subunit.

63. The cartridge of clause 62, wherein the first discrete subunit imparts a first amount of impact attenuation and the second discrete subunit imparts a second amount of impact attenuation, which is different from the first amount of impact attenuation.

64. The cartridge of clause 62 or clause 63, wherein the first discrete subunit is in a first region of the sole and the second discrete subunit is in a second region of the sole, which is different from the first region.

65. The cartridge of any one or more of clauses 50 through 64, wherein the top plate comprises a side configured to be coupled to a footwear article, and wherein the side comprises a surface texture conducive to bonding.

66. The cartridge of clause 65, wherein the bonding comprises an adhesive.

67. The cartridge of any one or more of clauses 50 through 66, wherein the bottom plate comprises a traction element.

68. A footwear article comprising the cartridge of any one or more of clauses 50 through 67.

69. The footwear article of clause 68, wherein the footwear article comprises any one or more of the features of clauses 1 through 45.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims. Since many possible alternative versions may be made of the subject matter described herein, without departing from the scope of this disclosure, it is to be understood that all matter herein set forth or shown in the accompanying drawings is to be interpreted as illustrative and not in a limiting sense.

The invention claimed is:

1. A footwear article comprising:

an upper;

a sole coupled to the upper;

the sole comprising:

a force attenuation component comprising a cartridge: the cartridge comprising:

a top plate;

a bottom plate;

a system of tubular support structures that is between the top plate and the bottom plate and that attenuates forces operating on at least one of the top plate or the bottom plate, wherein each tubular support structure in the system of tubular structures comprises a reference axis extending through the each tubular support structure at an angle being in a range of about 30 to about 90 degrees relative to a reference plane of the bottom plate; and an exoskeleton comprising a three-dimensional (3D) lattice of frame members comprising a network of interconnected nodes enclosing the system of tubular support structures, wherein each frame member is an elongated member interconnected to another elongated member and comprises a respective elongated member length between two nodes of the network of interconnected nodes.

2. The footwear article of claim 1, wherein the system of support structures comprises a first tubular support structure stacked atop a second tubular support structure.

3. The footwear article of claim 1, the sole comprising: a first force attenuation component comprising a cavity and a wall; and a second force attenuation component, wherein the cartridge is configured to nest in the cavity of the first force attenuation component.

4. The footwear article of claim 1, wherein:

the system of support structures and the exoskeleton comprise a first discrete subunit;

the sole comprises a second discrete subunit comprising a second system of support structures that is between the top plate and the bottom plate and that operates to attenuate forces operating on at least one of the top plate or the bottom plate; and a second exoskeleton that at least partially encloses the second system of support structures and that comprises a second lattice-type network of frame members.

5. The footwear article of claim 4, wherein the first discrete subunit comprises one or more properties that are different from the second discrete subunit.

6. The footwear article of claim 5, wherein the first discrete subunit imparts a first amount of impact attenuation and the second discrete subunit imparts a second amount of impact attenuation, which is different from the first amount of impact attenuation.

7. The footwear article of claim 5, wherein the first discrete subunit is in a first region of the sole and the second discrete subunit is in a second region of the sole, which is different from the first region.

8. The footwear article of claim 1, wherein the 3D lattice of frame members comprises a first frame member having a first property and a second frame member having a second property that is different from the first property.

9. The footwear article of claim 8, wherein the first property and the second property comprise a respective cross-sectional shape.

10. The footwear article of claim 8, wherein the first property and the second property comprise a respective degree of rectilinearity or curvilinearity.

11. The footwear article of claim 8, wherein the first property and the second property comprise a respective cross-sectional width or a respective cross-sectional area.

12. The footwear article of claim 1, wherein the exoskeleton comprises a repeating pattern of n-polygonal shapes.

13. The footwear article of claim 1, wherein the sole comprises a recess, and wherein the cartridge is nested in the recess.

14. The footwear article of claim 1, wherein the bottom plate comprises traction elements.

15. The footwear article of claim 1, wherein an exterior surface of each tubular support structure is a minimal surface.

16. A footwear article comprising:

an upper;

a sole coupled to the upper;

the sole comprising:

a force attenuation component comprising a cartridge: the cartridge comprising:

a top plate;

a bottom plate;

a first system of tubular support structures that comprises a first discrete subunit enclosed within a first exoskeleton comprising a first three-dimensional (3D) lattice of first frame members, which comprises a first network of interconnected nodes enclosing the first system of tubular support structures, wherein the first frame members comprise a first average length; and a second system of tubular support structures that comprises a second discrete subunit enclosed within a second exoskeleton comprising a second 3D lattice of second frame members, which comprises a second network of interconnected nodes enclosing the second system of tubular support structures, wherein the second frame members comprise a second average length, which is shorter than the first average length, wherein the first discrete subunit and the second discrete subunit are positioned between the top plate and the bottom plate, wherein a first reference axis extending through the first discrete subunit and a second reference axis extending through the second discrete subunit are oriented at an angle being in a range of about 30 to about 90 degrees relative to a reference plane of the bottom plate, and wherein the first system of tubular support structures and the second system of tubular support structures attenuate forces operating on at least one of the top plate or the bottom plate.

17. The footwear article of claim 16, wherein the first discrete subunit comprises one or more properties that are different from the second discrete subunit.

18. The footwear article of claim 16, wherein the first discrete subunit imparts a first amount of impact attenuation and the second discrete subunit imparts a second amount of impact attenuation, which is different from the first amount of impact attenuation.

19. The footwear article of claim 16, wherein the first discrete subunit is in a first region of the sole and the second discrete subunit is in a second region of the sole, which is different from the first region.

20. A footwear article comprising:

an upper;

a sole coupled to the upper;

the sole comprising:

a first force attenuation component comprising a recess;

a second force attenuation component comprising a cartridge nested in the recess and, the cartridge comprising:

a top plate;

a bottom plate; and a system of tubular support structures that is between the top plate and the bottom plate and that operates to attenuate forces operating on at least one of the top plate or the bottom plate; and an exoskeleton comprising a three-dimensional 3D lattice of elongated frame members, wherein the elongated frame members comprise a network of interconnected nodes enclosing the system of tubular support structures, wherein each tubular support structure in the system of tubular support structures comprises a reference axis extending through each tubular structure at an angle being in a range of about 30 to about 90 degrees relative to a reference plane of the bottom plate.

* * * * *